US007886825B2

(12) United States Patent
Van Hal et al.

(10) Patent No.: US 7,886,825 B2
(45) Date of Patent: Feb. 15, 2011

(54) FORMATION FLUID SAMPLING TOOLS AND METHODS UTILIZING CHEMICAL HEATING

(75) Inventors: Ronald E. G. Van Hal, Watertown, MA (US); Anthony Goodwin, Sugar Land, TX (US); Oliver C. Mullins, Ridgefield, CT (US); Peter S. Hegeman, Stafford, TX (US); Bhavani Raghuraman, Lexington, MA (US); Soraya S. Betancourt, Cambridge, MA (US); Cosan Ayan, Istanbul (TR); Ricardo Vasques, Sugar Land, TX (US); Francois Xavier Dubost, Orgeval (FR); Christopher Scott Del Campo, Houston, TX (US)

(73) Assignee: Schlumberger Technology Corporation, Ridgefield, CT (US)

( * ) Notice: Subject to any disclaimer, the term of this patent is extended or adjusted under 35 U.S.C. 154(b) by 1087 days.

(21) Appl. No.: 11/562,908

(22) Filed: Nov. 22, 2006

(65) Prior Publication Data

US 2008/0066904 A1 Mar. 20, 2008

Related U.S. Application Data

(60) Provisional application No. 60/827,188, filed on Sep. 27, 2006, provisional application No. 60/845,332, filed on Sep. 18, 2006.

(51) Int. Cl.
*E21B 43/24* (2006.01)

(52) U.S. Cl. ..... 166/302; 166/300

(58) Field of Classification Search ..... 166/250.1, 166/300, 302, 162; 73/64.45
See application file for complete search history.

(56) References Cited

U.S. PATENT DOCUMENTS

| | | | |
|---|---|---|---|
| 2,035,382 | A | 3/1936 | Abele |
| 2,747,401 | A | 5/1956 | Doll |
| 3,746,088 | A | 7/1973 | Haskin et al. |
| 3,859,851 | A | 1/1975 | Urbanosky |
| 4,339,948 | A | 7/1982 | Hallmark |

(Continued)

FOREIGN PATENT DOCUMENTS

EP 0747569 B1 3/2003

(Continued)

OTHER PUBLICATIONS

Burgess, et al., Formation Testing and Sampling Through Casing, Oilfield Review, Spring 2002, pp. 46-57.

(Continued)

*Primary Examiner*—Daniel P Stephenson
(74) *Attorney, Agent, or Firm*—James McAleenan; Vincent Loccisano; Brigid Laffey

(57) ABSTRACT

A formation fluid sampling tool is provided with reactants which are carried downhole and which are combined in order to generate heat energy which is applied to the formation adjacent the borehole. By applying heat energy to the formation, the formation fluids are heated, thereby increasing mobility, and fluid sampling is expedited.

34 Claims, 10 Drawing Sheets

U.S. PATENT DOCUMENTS

| | | | | |
|---|---|---|---|---|
| 4,353,249 | A | 10/1982 | Lagus et al. | |
| 4,392,376 | A | 7/1983 | Lagus et al. | |
| 4,475,596 | A | 10/1984 | Papst | |
| 4,860,581 | A | 8/1989 | Zimmerman et al. | |
| 4,936,139 | A | 6/1990 | Zimmerman et al. | |
| 4,994,671 | A | 2/1991 | Safinya et al. | |
| 5,266,800 | A | 11/1993 | Mullins | |
| 5,269,180 | A | 12/1993 | Dave et al. | |
| 5,335,542 | A | 8/1994 | Ramakrishnan et al. | |
| 5,497,321 | A | 3/1996 | Ramakrishnan et al. | |
| 5,939,717 | A | 8/1999 | Mullins | |
| 6,065,544 | A | 5/2000 | Holbert | |
| 6,301,959 | B1 | 10/2001 | Hrametz et al. | |
| 6,755,246 | B2 | 6/2004 | Chen et al. | |
| 6,766,854 | B2 | 7/2004 | Ciglenec et al. | |
| 6,964,301 | B2 | 11/2005 | Hill et al. | |
| 7,000,697 | B2 | 2/2006 | Goode et al. | |
| 7,081,615 | B2 | 7/2006 | Betancourt et al. | |
| 7,090,012 | B2 | 8/2006 | Hill et al. | |
| 7,191,831 | B2 | 3/2007 | Reid et al. | |
| 7,194,902 | B1 | 3/2007 | Goodwin et al. | |
| 2006/0081374 | A1* | 4/2006 | Bland et al. | 166/300 |
| 2006/0137873 | A1 | 6/2006 | Caudwell et al. | |
| 2006/0162935 | A1 | 7/2006 | MacDougall | |
| 2006/0243033 | A1 | 11/2006 | Freemark et al. | |
| 2006/0248949 | A1 | 11/2006 | Gregory et al. | |

FOREIGN PATENT DOCUMENTS

| | | | |
|---|---|---|---|
| GB | 2405652 | A | 3/2005 |
| WO | 02057596 | A1 | 7/2002 |
| WO | 2006003092 | A1 | 1/2006 |
| WO | 2006083914 | A2 | 8/2006 |

OTHER PUBLICATIONS

Zeybek, M., et al., Estimating Multiphase Flow Properties Using Pressure and Flowline Water-Cut Data from Dual Packer Formation Tester Interval Tests and Openhole Array Resistivity Measurements, Society of Petroleum Engineers, SPE 71568, 2001, pp. 1-8.

Gateau, P., et al, Heavy Oil Dilution, Oil & Gas Science and Technology-Rev. IFP, 2004, vol. 59, No. 5, pp. 503-509.

Meyer, R.F., et al., Heavy Oil and Natural Bitumen—Strategic Petroleum Resources, U.S. Geological Survey, Fact Sheet 70-0., Aug. 2003, Online Version 1.0, pp. 1-5.

Alpak, F.O., et al., Simultaneous Estimation of In-Situ Multi-Phase Petrophysical Properties of Rock Formations from Wireline Formation Tester and Induction Logging Measurements, Society of Petroleum Engineers, SPE 90960, 2004, pp. 1-18.

Canas, J.A., et al., Viscous Oil Dynamics Evaluation for Better Fluid Sampling, Society of Petroleum Engineers International, SPE/PS-CIM/CHOA 97767, PS2005-347, 2005, pp. 1-11.

Ovalles, C., et al., Upgrading of extra-heavy crude oil by direct use of methane in the presence of water, Deuterium-labelled experiments and mechanistic considerations, Fuel, 1995, vol. 74, No. 8, pp. 1162-1168.

Pazuki, G.R., et al., A modified Flory-Huggins model for prediction of asphaltenes precipitation in crude oil, Fuel, 2006, vol. 85, pp. 1083-1086.

E., Hong, et al., A study of asphaltene solubility and precipitation, Fuel, 2004, vol. 83, pp. 1881-1887.

Angle, C.W., et al, Precipitation of asphaltenes from solvent-diluted heavy oil and thermodynamic properties of solvent-diluted heavy oil solutions, Fuel, 2006, vol. 85, pp. 492-506.

Rogel, E., Thermodynamic Modeling of Asphaltene Aggregtion, Langmuir, 2004, vol. 20, pp. 1003-1012.

Mutelet, F. et al., Solubility Parameters of Crude Oils and Asphaltenes, Energy & Fuels, 2004, vol. 18, pp. 667-673.

Cai, H. -Y., et al., The impact of solid additives on the apparent solubility of hydrogen in petroleum fractions and model hydrocarbon liquids, Fuel, 2001, vol. 80, pp. 1065-1077.

Cai, H. -Y., et al., Hydrogen solubility measurements in heavy oil and bitumen cuts, Fuel, 2001, vol. 80, pp. 1055-1063.

Heron, J.J., et al., Oil Sands: The Canadian Experience, Ann. Rev. Energy, 1983, vol. 8, pp. 137-163.

Speight, J.G., Upgrading Heavy Feedstocks, Ann. Rev. Energy, 1986, vol. 11, pp. 253-274.

Oblad, A.G., et al., Tar Sand Research and Development at the University of Utah, Ann. Rev. Energy, 1987, vol. 12, pp. 283-356.

Retsina, T., et al., The theory of a vibrating-rod densimeter, Applied Scientific Research, 1986, vol. 43, pp. 127-158.

Retsina, T., et al., The theory of a vibrating-rod viscometer, Applied Scientific Research, 1987, vol. 43, pp. 325-346.

Vermeulen, F., et al., In Situ Electromagnetic Heating for Hydrocarbon Recovery and Environmental Remediation, Journal of Canadian Petroleum Technology, Aug. 2000, vol. 39, No. 8, pp. 24-28.

Meyer, R.F., et al., Natural Bitumen and Extra-Heavy Oil, World Energy Council 2004 Survey of Energy Resources, Chapter 4, pp. 93-117.

McCarty, R.D., et al., Thermophysical Properties of Parahydrogen from the Freezing Liquid Line to 5000 R for Pressures to 10,000 Psia, National Bureau of Standards, Technical Note 617, 1972, pp. 1-169.

Speight, J. G., Asphaltenes, The Chemistry and Technology of Petroleum, 3rd Edition, Marcel and Dekker Inc., 1999, pp. 412-467.

Huner, B., et al., Cylinder drag at low Reynolds number, The Physics of Fluids, 1977, vol. 20, No. 8, pp. 1211-1218.

What are oilsands and heavy oil?, http://www.centreforenergy.com/generator2.asp?xml=/silos/ong/oilsands/oilsandsAndHeavyOilOverview01XML.asp&template=1,1,1, Date Accessed Apr. 16, 2007, pp. 1-16.

Boyd, Acoustic Energy: An Innovative Technology for Stimulating Oil Wells, https://www.ofsr.slb.com/artman/publish/printer_shtml, Date Accessed Apr. 16, 2007, p. 1.

* cited by examiner

FORMATION FLUID SAMPLING TOOLS AND METHODS UTILIZING CHEMICAL HEATING

PRIORITY

This application claims priority from co-pending, commonly assigned U.S. Provisional Application Ser. No. 60/827,188 filed Sep. 27, 2006 and U.S. Provisional Application No. 60/845,332 filed Sep. 18, 2006.

BACKGROUND OF THE INVENTION

1. Field of the Invention

This invention relates broadly to oilfield exploration. More particularly, this invention relates to apparatus and methods for expediting the downhole sampling of formation hydrocarbons.

2. State of the Art

One technique utilized in exploring a subsurface formation for oil is to obtain oil samples downhole. Various tools such as the MDT and the CHDT (trademarks of Schlumberger) tools are extremely useful in obtaining and analyzing such samples. Tools such as the MDT tool (see, e.g., U.S. Pat. No. 3,859,851 to Urbanosky, and U.S. Pat. No. 4,860,581 to Zimmerman et al., which are hereby incorporated by reference herein in their entireties) typically include a fluid entry port or tubular probe cooperatively arranged within one or more wall-engaging packers for isolating the port or probe from the borehole fluids, one or more sample chambers which are coupled to the fluid entry by a flow line having one or more control valves arranged therein, means for controlling a pressure drop between the formation pressure and sample chamber pressure, and sensors for obtaining information relating to the fluids. The sensors may include pressure transducers for monitoring the pressure of the fluid. In addition, optical sensors may be supplied by an OFA, CFA or LFA (all trademarks of Schlumberger) module (see, e.g., U.S. Pat. No. 4,994,671 to Safinya et al., U.S. Pat. No. 5,266,800 to Mullins, and U.S. Pat. No. 5,939,717 to Mullins which are hereby incorporated by reference herein in their entireties) in order to determine the make-up of the fluid being admitted into the tool, etc.

The CHDT tool is similar in various manners to the MDT tool, but is used when the borehole is cased with a casing. The CHDT tool includes a mechanism for perforating the casing such as a drilling mechanism (see, e.g., "Formation Testing and Sampling through Casing", *Oilfield Review*, Spring 2002 which is hereby incorporated by reference herein in its entirety) and for plugging the casing after testing.

The MDT and CHDT tools in their normal applications are used to obtain formation oil samples with a low viscosity; typically up to 30 cp. In certain circumstances and with special adaptations, oils with a higher viscosity have been sampled. It is believed that the maximum viscosity that has been sampled using an MDT or CHDT tool is an oil having a viscosity of 3200 cp, but the sampling process often requires several adaptations and can take many hours.

It will be appreciated by those skilled in the art that exploitation of more viscous hydrocarbons is becoming increasingly important due to the depletion of conventional low viscosity hydrocarbon reserves. Sampling these oils for reservoir characterization is very challenging as oils with a higher viscosity have a low mobility and are hard to sample or cannot be sampled at all depending on the local circumstances. In fact, the low mobility of these oils often results in very long sampling times or makes it impossible to retrieve a sample. If sampling times are too long there is a chance that the tool can get stuck in the borehole.

While larger sampling ports on the sampling tool can improve the flow of oil into the sampling tool, the tool size and sealing concerns limit the maximum size of the sampling ports.

SUMMARY OF THE INVENTION

It is therefore an object of the invention to provide sampling tools and methods which expedite the sampling of formation hydrocarbons, and particularly, although not exclusively, the sampling of high viscosity hydrocarbons.

In accord with this object, which will be discussed in detail below, the sampling tool of the invention is provided with chemicals (reactants) which are carried downhole and which are mixed in order to generate heat energy which is applied to the formation adjacent the borehole. According to one embodiment of the invention, the heat energy which is to be applied by the sampling tool to the formation is generated downhole in the tool by mixing reactants stored in separate chambers of the tool to generate an exothermic reaction which is used to increase the temperature of a fluid which includes the reactants. The heated fluid is then injected into the formation. Alternatively, energy from an exothermic reaction of the reactants is used to heat another fluid such as water which is injected into the formation. According to another embodiment, the heat energy is generated by first injecting one reactant into the formation and then injecting another reactant into the formation such that the reactants react in the formation to generate heat. According to yet other embodiments, a solution of the reactants, a fluid heated by the exothermic reaction, or a sequence of the reactants is injected into a dual packer interval adjacent the formation in order to apply heat energy to the formation.

Different types of reactants may be utilized. According to certain embodiments of the invention, a dissolving (salvation) reaction is utilized to generate heat energy (hereinafter "heat"). According to other embodiments, an acid-base reaction is utilized to generate heat. According to yet other embodiments of the invention, a reduction-oxidation reaction is utilized to generate heat. In one embodiment the reactants are applied to water and used to heat water, and the resulting solution is applied to the formation via the injection of the solution into the formation. In another embodiment, the reactants are applied to water in order to generate steam, and the heat is applied to the formation via the injection of steam (or hot water formed from the steam) into the formation. In another embodiment, the reactants are applied to water to generate a hot solution, the heat is transferred from the hot solution to water, and the hot water is injected into the formation. In another embodiment, the heat is used to generate a hot acid solution, and the heat is applied to the formation via the injection of a hot acid solution into the formation. In another embodiment, the heat is used to generate a hot fluid, and the heat is applied to the formation via the injection of the hot fluid into the formation.

In one embodiment of the invention, the sampling tool is capable of generating fluid which is at least 50° C. hotter than the ambient formation temperature. In another embodiment of the invention, the sampling tool is capable of generating fluid which is at least 100° C. hotter than the ambient formation temperature. In another embodiment of the invention, the sampling tool is capable of generating fluid of at least 200° C. In another embodiment of the invention, the sampling tool is capable of generating fluid at within 10° C. of the maximum water temperature obtainable at the formation pressure without generating steam.

Many different types of apparatus may be utilized to store the reactants, to mix the reactants, and to inject hot fluid into the borehole or formation. In one embodiment of the invention, the pumps of a sampling tool which are utilized to pump fluid from the formation into the tool are used to pump the hot fluid into the formation. In another embodiment of the invention, separate pumps are used for injecting hot fluid into the formation and withdrawing fluid from the formation into the sampling tool. In one embodiment, the hot fluid is injected through the probe port of the sampling tool through which fluid from the formation is withdrawn. In another embodiment the hot fluid is injected through one port, and fluid is withdrawn through another port.

Additional objects and advantages of the invention will become apparent to those skilled in the art upon reference to the detailed description taken in conjunction with the provided figures.

DETAILED DESCRIPTION OF THE PREFERRED EMBODIMENTS

This invention relates to sampling tools and methods which expedite the sampling of formation hydrocarbons by utilizing chemical reactants carried downhole by the sampling tool in order to generate heat (energy) which is applied to the formation. For purposes herein, water is to be considered a chemical reactant if it is used in conjunction with another reactant to generate heat. The heat is used to reduce the viscosity of the hydrocarbons in the formation so that sampling of the hydrocarbons by the sampling apparatus is expedited. Any sampling apparatus known in the art may be utilized, provided it carries or is modified to be able to carry chemical reactants which can generate heat, and provided it can inject the reactants into the formation (or into the borehole adjacent the formation), or can mix the reactants together first and then inject the reactants into the formation (or into the borehole adjacent the formation). By way of example and not limitation, tools such as the previously described MDT tool of Schlumberger (see, e.g., previously incorporated U.S. Pat. No. 3,859,851 to Urbanosky, and U.S. Pat. No. 4,860,581 to Zimmerman et al.) with or without OFA, CFA or LFA module (see, e.g., previously incorporated U.S. Pat. No. 4,994,671 to Safinya et al., U.S. Pat. No. 5,266,800 to Mullin, U.S. Pat. No. 5,939,717 to Mullins), or the CHDT tool (see, e.g., previously incorporated "Formation Testing and Sampling through Casing", *Oilfield Review*, Spring 2002) may be utilized. An example of a tool having the basic elements to implement the invention is seen in schematic in FIG. 1. Other examples of tools are shown in FIGS. 6-10 and discussed below.

Figure 1:
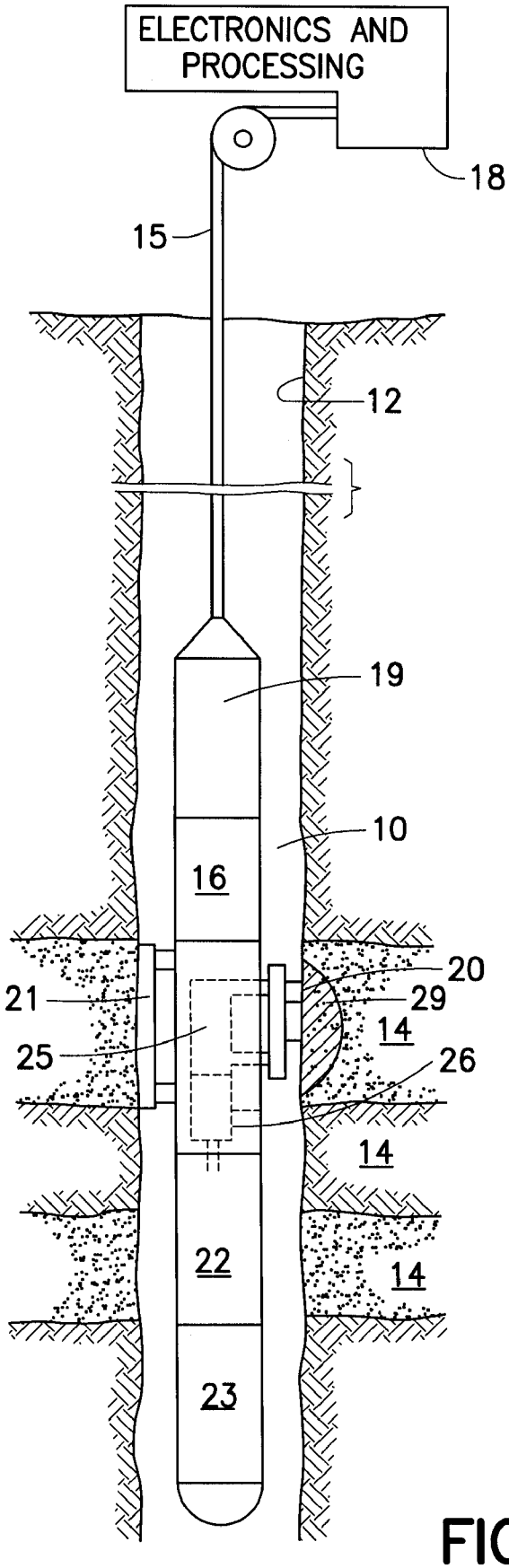
FIG. 1 is a broken highly schematic diagram showing a borehole tool with an injection/sampling port and a high energy zone adjacent thereto.

Turning now to FIG. 1, a borehole logging tool 10 for testing earth formations and optionally analyzing the composition of fluids from the formation 14 in accord with invention is seen. As illustrated, the tool 10 is suspended in the borehole 12 from the lower end of a typical multiconductor cable 15 that is spooled in the usual fashion on a suitable winch (not shown) on the formation surface. On the surface, the cable 15 is electrically connected to an electrical control system 18. The tool 10 includes an elongated body 19 which encloses the downhole portion of the tool control system 16. The elongated body 19 carries a probe 20 and an anchoring member 21 and/or packers (not shown in FIG. 1). The probe 20 is preferably selectively extendible as is the anchoring member 21 and they are respectively arranged on opposite sides of the body. The probe 20 is equipped for selectively sealing off or isolating selected portions of the wall of borehole 12 such that pressure or fluid communication with the adjacent earth formation is established. Also included with tool 10 are reactant holding chamber block 22, fluid collecting chamber block 23, an optional fluid analysis module 25, and an optional second port 26. As set forth in detail hereinafter, reactant chemicals which are used downhole to generate heat via an exothermic reaction are held in the reactant holder chamber block, preferably in at least two chambers. In some embodiments, the chemicals may be mixed by a mixer (not shown in FIG. 1) and then injected via flow lines (not shown in FIG. 1) and through probe 20 into the borehole or formation in order to warm the formation. In other embodiments, one or more pumps (not shown in FIG. 1) may be used to pump the chemicals from one chamber into the other for mixing, or back and forth between chambers for mixing. In other embodiments, the chemicals may be separately injected into the borehole or formation in order to warm the formation. Separate injection may be accomplished sequentially, coincidentally, or alternatingly. In any event, after injection and warming, the tool 10 is used to obtain formation fluids. The fluid is obtained by causing the pressure at the probe 20 (or at another probe or port location) to be below the local formation pressure, and thereby inducing formation fluids which have been warmed by the formation to flow into the tool. Initially, the fluid drawn into the tool may be the fluid which was injected into the formation or borehole, and the fluid analysis module 25 is useful for differentiating between injection fluid and formation fluid. The injection fluid may be expelled through port 26 if desired. When formation fluids are obtained, they are preferably sent via flow lines (not shown in FIG. 1) to the fluid collecting chamber block 23 and stored. Control of the probe 20, the fluid analysis section 25, and the flow paths to and from the probe or port and to and from the reactant holding chamber block 22 and fluid collecting chamber block 23 is maintained by the electrical control systems 16 and 18.

It should be appreciated that separate blocks are not required for the reactants and for fluid collecting. Thus, if desired, the reactants may be held in chambers which may be later be used for collecting fluid after the reactants have been discharged. It should also be appreciated that according to the invention, formation fluids need not be brought to the surface, particularly when a fluid analysis module 25 is provided so that formation fluid analysis may be carried out downhole.

As set forth above, the chemical reactants carried downhole in the tool 10 are used to generate an exothermic chemical reaction which is used to heat the reservoir (formation)

adjacent the tool. In one embodiment of the invention, the sampling tool is capable of generating fluid which is at least 50° C. hotter than the ambient formation temperature. In another embodiment of the invention, the sampling tool is capable of generating fluid which is at least 100° C. hotter than the ambient formation temperature. In another embodiment of the invention, the sampling tool is capable of generating fluid of at least 200° C. In another embodiment of the invention, the sampling tool is capable of generating fluid at within 10° C. of the maximum water temperature obtainable at the formation pressure without generating steam.

Many mechanisms for using the heat generating chemical reactants are discussed hereinafter, but however used, the goal is to generate a high-energy zone 29 in the formation near the sampling port of the tool 10. The high-energy zone 29 reduces the viscosity of the hydrocarbons contained therein, and thereby increases the mobility of those hydrocarbons. This high-energy zone effectively enlarges the sampling port by creating a zone with a relatively small pressure drop thus extending the larger pressure drop to an area deeper in the formation. The high-energy zone will decline during the sampling giving its energy to its surroundings and to the hydrocarbons passing through this zone. As discussed below, several techniques can be used to maintain the high-energy zone.

Figure 2:
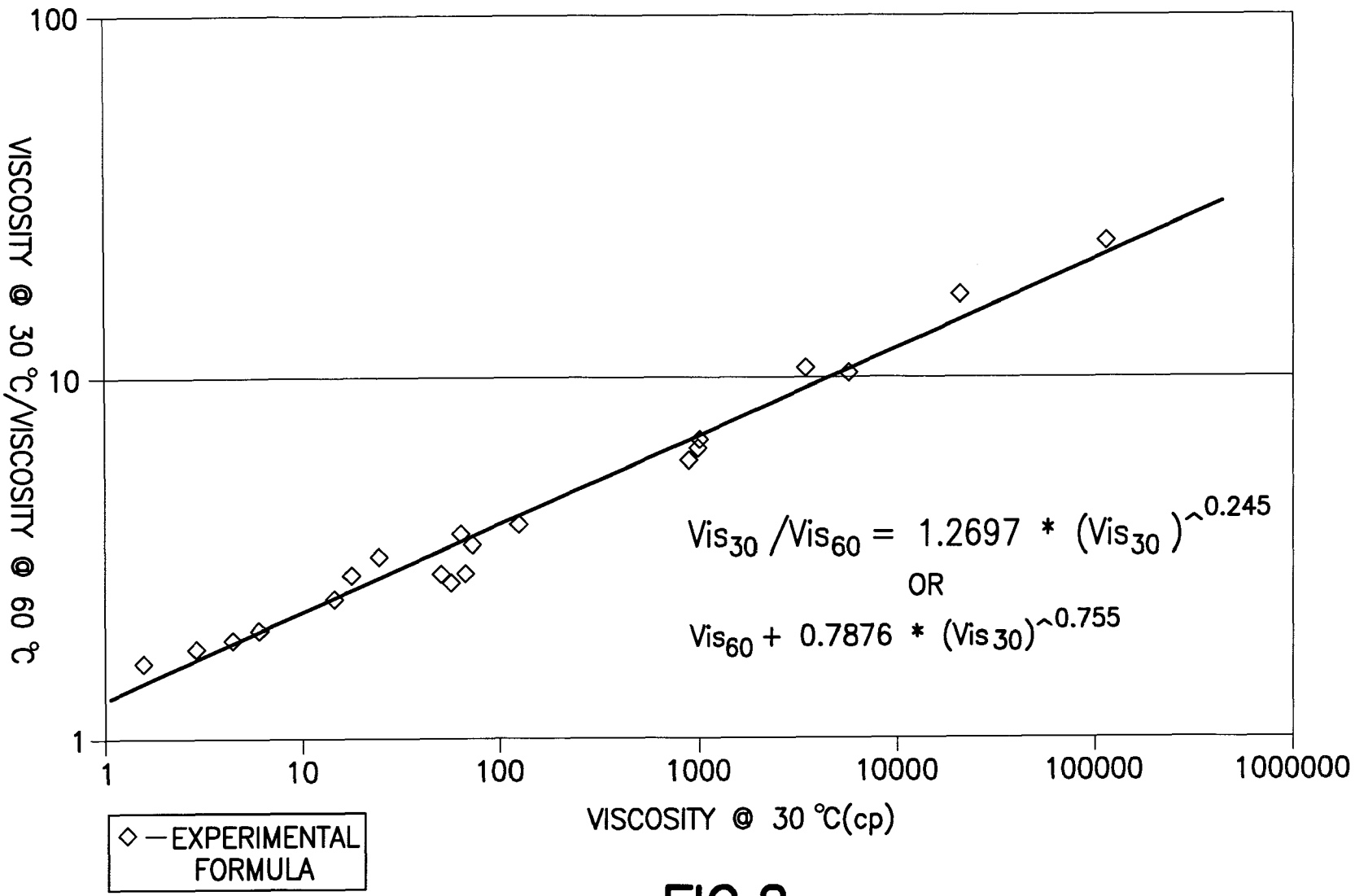
FIG. 2 is a plot showing the temperature dependence of the viscosity of different dead oils.

Although it is believed that there is no direct relation between API gravity and the viscosity, it is generally thought that heavier oils are more viscous. The viscosity of hydrocarbons is highly variable and varies from 100 cp to 10,000 cp for heavy oils to over several 100,000 cp for bitumen. The viscosity varies inversely with temperature, with an oil sample having a lower viscosity at a higher temperature. As seen in FIG. 2 where the viscosity at 30° C. of twenty different dead oil samples from all over the world is plotted versus the ratio of the viscosities of those samples at 30° C. and 60° C., the absolute and relative variations are dependent on the original viscosity and become larger at higher viscosities. Thus, a temperature rise of 30° C. of an oil of viscosity 1000 cp will reduce this viscosity by about a factor of seven, resulting in an effective viscosity of about 140 cp, whereas, a temperature rise of 30° C. of an oil of viscosity of approximately 100,000 will reduce by about a factor of twenty, resulting in an effective viscosity of about 5000 cp. It is therefore very desirable to significantly raise the temperatures of very viscous oil samples if samples are to be taken by a borehole tool.

According to the invention, fluid is heated via a chemical reaction. For purposes of the invention, "chemical reaction" is to be understood to include chemical dissolution where a chemical is dissolved in water or another liquid and may be retrieved by evaporating the water or other liquid. Chemical reactions in many cases are relatively quick (e.g., within five minutes) and therefore are particularly suited where time is an issue. In one embodiment, a fluid such as water is held in a chamber of a reactant holding chamber block or the fluid collecting chamber block. By way of example only, if three liters of water are stored in the chamber, the energy required to heat three liters of water from, e.g., 20° C. (which is the low end of the typical reservoir temperatures) to e.g., 200° C. (above which certain tools may not be able to handle the fluid due to material constraints) is about 2,250 kJ or 750 kJ/l. The steam pressure for 200° C. is about 225 psi or 15.5 bar. If hot water is preferred above steam and the formation pressure is below 225 psi then the maximum temperature can be reduced to for example 180° C., which has a steam pressure of 145 psi or about 10 bars.

According to one set of embodiments, exothermic dissolving "reactions" are utilized; i.e., one or more chemicals are dissolved in or reacted with water to heat the water. An example of such an exothermic dissolving reaction is the dissolution of one or more salts in water. For example, dissolving $MgCl_2(s)$ in water generates approximately 150 kJ/mol. The solubility of $MgCl_2$ at room temperature is slightly more than 5 mol/l, and therefore about 800 kJ/l are generated. Another example is the dissolution of KOH(s) in water, which generates 57 kJ/mol. With a solubility of about 14 mol/l this will result in about 790 kJ/l. It is noted that the KOH reaction results in a strong alkaline solution which might alter the composition of the oil. Other salts may be utilized, including but not limited to aluminum bromide, aluminum chloride, magnesium sulfate, sodium hydroxide, etc.

Other chemicals decompose or react with water in an exothermic reaction. An example is the reaction (hydrolosis) between phosphorous trichloride ($PCl_3$) and water to form ortho-phosphoric acid ($H_3PO_3$) and hydrochloric acid (HCl). This reaction generates 272 kJ/mol. With 3HCl being generated per mol of phosphorous trichloride and a maximum solubility of HCl of 12 mol/l, this reaction will generate about 1000 kJ/l. Other compounds may be used in lieu of phosphorous trichloride such as phosphorous pentoxide, phosphorous pentachloride, sulfur trioxide, etc. It is noted that the reaction of $PCl_3$, as do most decomposition or hydrolysis reactions, generates a strong acidic solution which might cause the dissolution of some of the oil components in the water phase. It is also noted that the acidic solution may also be corrosive to the tool, and according to one embodiment of the invention discussed hereinafter, care is taken to modify the tool to account for the corrosive injection fluid.

According to other embodiments, acid-base reactions are utilized to generate heat. The reaction of a strong acid with a strong base generates a pH-neutral solution if equal amounts of acid and base are used. Acid-base reactions typically generate 56 kJ/mol reactant. For example, the reaction of NaOH (aq) with HCl(aq) will generate a NaCl solution and 56 kJ/mol. The maximum solubility of NaCl in water at 20° C. is about 6 mol/l and the energy generated will thus be around 340 kJ/l. If more than 340 kJ/l is desired, the acid-base reaction can be combined with the dissolution of NaOH(s) in water to form NaOH(aq). The heat of solution for NaOH is 44 kJ/mol resulting in 100 kJ/mol for the complete reaction and thus about 600 kJ/l. As another acid-base reaction example, NaOH pellets can be reacted with $HNO_3$. The solubility of $NaNO_3$ is about 70% higher than the solubility of NaCl and therefore, although the reaction of NaOH pellets with $HNO_3$ gives the same amount of energy per mole, the energy per liter rises to about 1000 kJ/l.

In the above examples, the energy released due to the dilution of a high acid concentration by its reaction with a base is not taken into account. This energy is in most cases not high enough to be a serious factor if the temperature has to be raised significantly (e.g., from 20° C. to 200° C.). However, the dilution of sulfuric acid is well known for its release in energy and is able to generate several 100 kJ/l which will raise water temperature by 100° C. and may be sufficient in certain circumstances. Thus, according to other embodiments of the invention, heat is generated from the solution and dilution of acids in water. Many strong acids, both in gas as well as liquid form, can be diluted and dissolved in water under the release of energy. The list of compounds includes but is not limited to hydrochloric acid, sulfuric acid, pyro-phosporous acid, etc.

In an acid-base reaction, the acid can be formed in-situ from a precursor that reacts with water. The acid can subsequently react with a base to form a neutral solution. Stated another way, heat is generated from a combination of the chemical reaction between water and a second compound which generates an acid and a subsequent reaction between that acid and a base. Alternatively, the reactions are done together as a one-step reaction. As an example, $PCl_3$ reacts with water to form HCl and $H_3PO_3$. The HCl can (subsequently) react with NaOH to form NaCl. If three moles NaOH are used per mole $PCl_3$ all the HCl is reacted away and about 900 kJ/mol energy is released, although the solution is not pH-neutral. The $H_3PO_3$ is an acid and about another 1.5 mole of NaOH is required to obtain a neutral solution. To obtain a neutral solution, energy will be consumed and therefore the total amount of energy released (i.e., the net) will be 750 kJ/l. If NaOH pellets are used, the additional heat of solution will bring these values to about 1150 kJ/l and 1100 kJ/l respectively.

According to other embodiments of the invention, heat is generated from a combination of the solution and dilution of a salt in water with the generation of heat from the chemical reaction between water and a second compound and the generation of heat from the reaction between acid and base. This combines the energy of three different reactions. An example of such a reaction is when an alkaline solution is formed in-situ by dissolving NaOH (s). In parallel, $PCl_3$ reacts with water to form $H_3PO_4$ and HCl. Both solutions are subsequently mixed. The total energy released from this reaction is about 585 kJ/mol $PCl_3$.

According to yet other embodiments, heat is generated from an oxidation-reduction reaction. For example, hydrogen peroxide can be exothermically decomposed under the influence of acid to form water and oxygen and release heat. Also, hydrogen gas and oxygen gas can be reacted to form water (steam).

In any of the above embodiments, it is possible to utilize the heat generated by the exothermic reaction to heat another liquid (e.g., water) via a heat exchanger (not shown). Thus, rather than injecting a solution into the formation, only water which was heated via the heat exchange would be injected into the formation. In addition, in certain circumstances (e.g., low pressure), it may be possible to generate steam from a reaction, and utilize only the steam for injection into the formation. In those circumstances, the steam may be injected as steam, or it may be compressed or cooled sufficiently away from the reaction site so that it turns into very hot water which can be injected into the formation. It should be noted that where the exothermic reaction does not generate enough heat to create steam under standard downhole conditions, it is possible to adjust the pressure of the reaction chamber so that steam will be generated. In this manner only water or steam will be injected into the formation as opposed to chemical reactants.

According to one embodiment, the injection of a highly concentrated HCl solution has the advantage of making the formation more permeable. The injection of a hot HCl solution can therefore improve the flow of hydrocarbons by both a reduction in viscosity and a rise in permeability. A hot HCl solution can be formed from the reaction between $PCl_3$ or $PCl_5$ and water (i.e., the hydrolysis of the reactants in water) or by other methods. It is noted that the injection of strong alkaline or acidic solutions into the formation can charge and dissolve components in the oil which could result in a sample that is not representative for the oil. However, during injection the injected water does not mix with the oil, and thus only the oil at the interface with the injected water is in contact with the very acidic solution. After disposal of the first fraction of oil a representative sample will be obtained.

According to another embodiment of the invention, injection of hot water can be combined with other chemicals that raise the permeability of the reservoir. An example is the use of fluoride containing reagents. Hydrofluoric acid (HF) can reduce the viscosity of oil and improve the permeability of a formation. Chemicals that form HF in-situ or a fluoride containing solution that will be acidized can be used. For example, this solution can be obtained by reaction of fluor containing components or by mixing of fluoride salts (e.g., potassium fluoride) with an acidic solution (e.g., ortho-phosphoric acid), or by other methods.

According to a further embodiment, proppants or other components known to improve permeability are combined with hot water prior to injection into the formation. In one embodiment, this is accomplished by adding the permeability-increasing components to the hot liquid. In another embodiment, this is accomplished by adding the components to a fluid before the fluid is heated.

Figure 3:
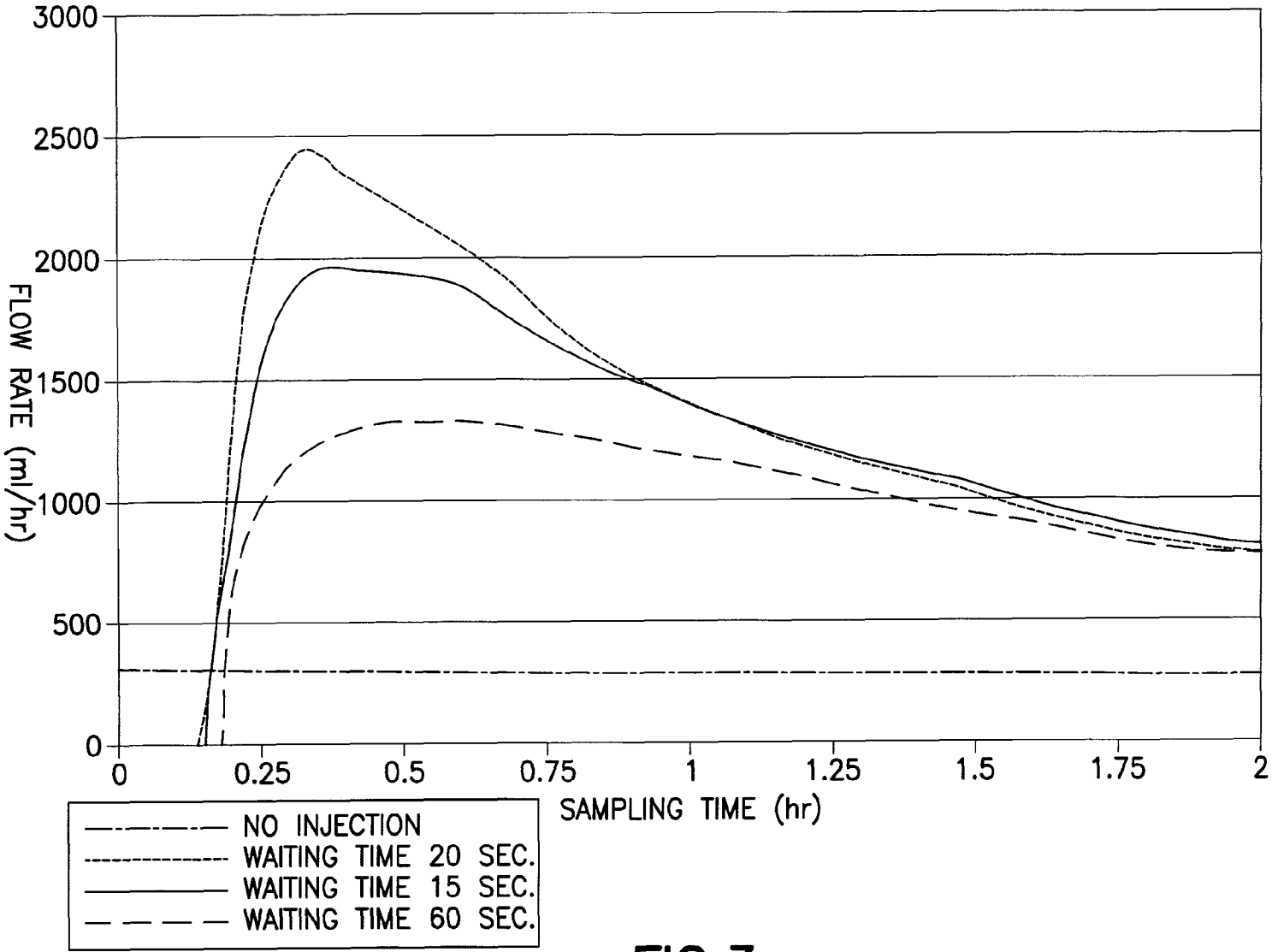
FIG. 3 is a model generated plot of flow rate as a function of sampling time after no injection, and after injection of hot fluid into a formation after different waiting times.
Figure 4:
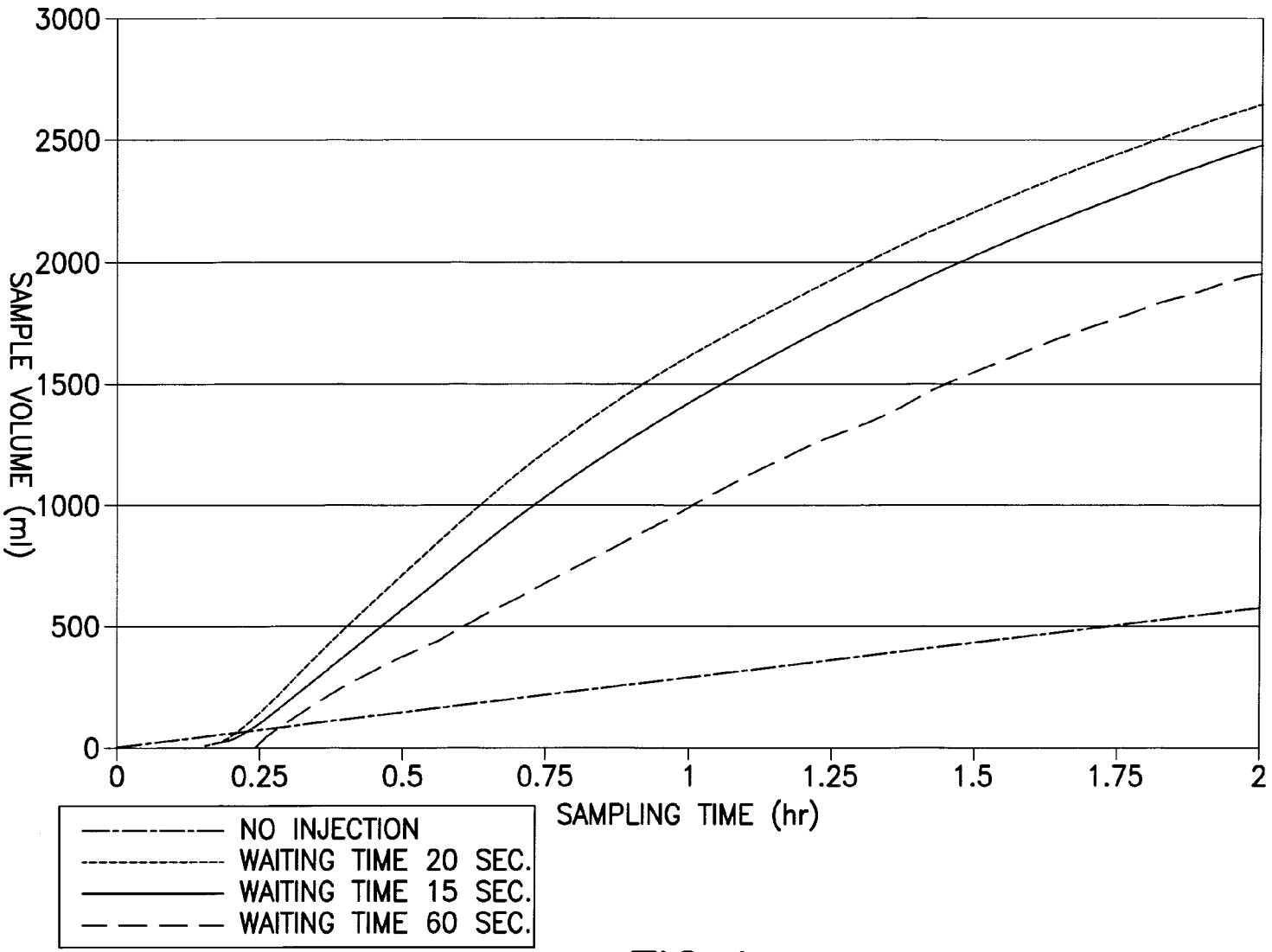
FIG. 4 is a model generated plot of sample volume as a function of sampling time after no injection, and after injection of hot fluid into a formation after different waiting times.

In accord with one embodiment of the invention, the injection of hot water/steam into a formation was simulated. The simulation assumed that 2.93 liters of 200° C. water were injected into a reservoir having a porosity of 20%, a permeability of 1000 mD and a reservoir temperature of 30° C. The viscosity of the oil in the reservoir was set at 979 cp. The size of the sampling port was set at 16 $cm^2$ and is assumed to be in direct contact with the formation. The maximum injection and sampling rates were set at 9000 ml/hr and the maximum and minimum pressure were set at 100 bars above the formation pressure for injection and 50 bars below the formation pressure for sampling. The results of the simulation are seen in FIG. 3 where a plot of flow rate of oil as a function of sampling time and FIG. 4 where a plot of the sample (oil) volume as a function of sampling time are shown for four cases: no injection of water, and waiting times of twenty seconds, fifteen minutes, and sixty minutes after injection of water. Varying the time between injection and sampling simulates the spreading of energy. FIG. 3 and FIG. 4 show that with the selected parameters of the model, the largest flow rates and total sample sizes are obtained when the time between injection and sampling is small and thus the injected energy is concentrated around the sampling port.

As will be appreciated by those skilled in the art, the injection of hot fluid (e.g., water, steam, acid, etc.) creates a high-energy zone around the injection-sampling port. This zone contains mainly the fluid and a little remaining oil, both having a low viscosity. The start of sampling creates a pressure drop at the sampling port to start the flow of fluids. Low viscosity fluids require a small pressure drop to start flowing whereas high viscosity fluids require a much higher pressure drop to create the same flow rate. Thus, the high-energy zone requires only a relatively small pressure drop and a larger part of the maximum pressure drop is used deeper in the formation. However, due to the high-energy zone, the surface area at which this pressure drop takes place is much larger than without the high-energy zone where the size of the sample port determines the surface area over which the pressure drop occurs.

Figure 5:
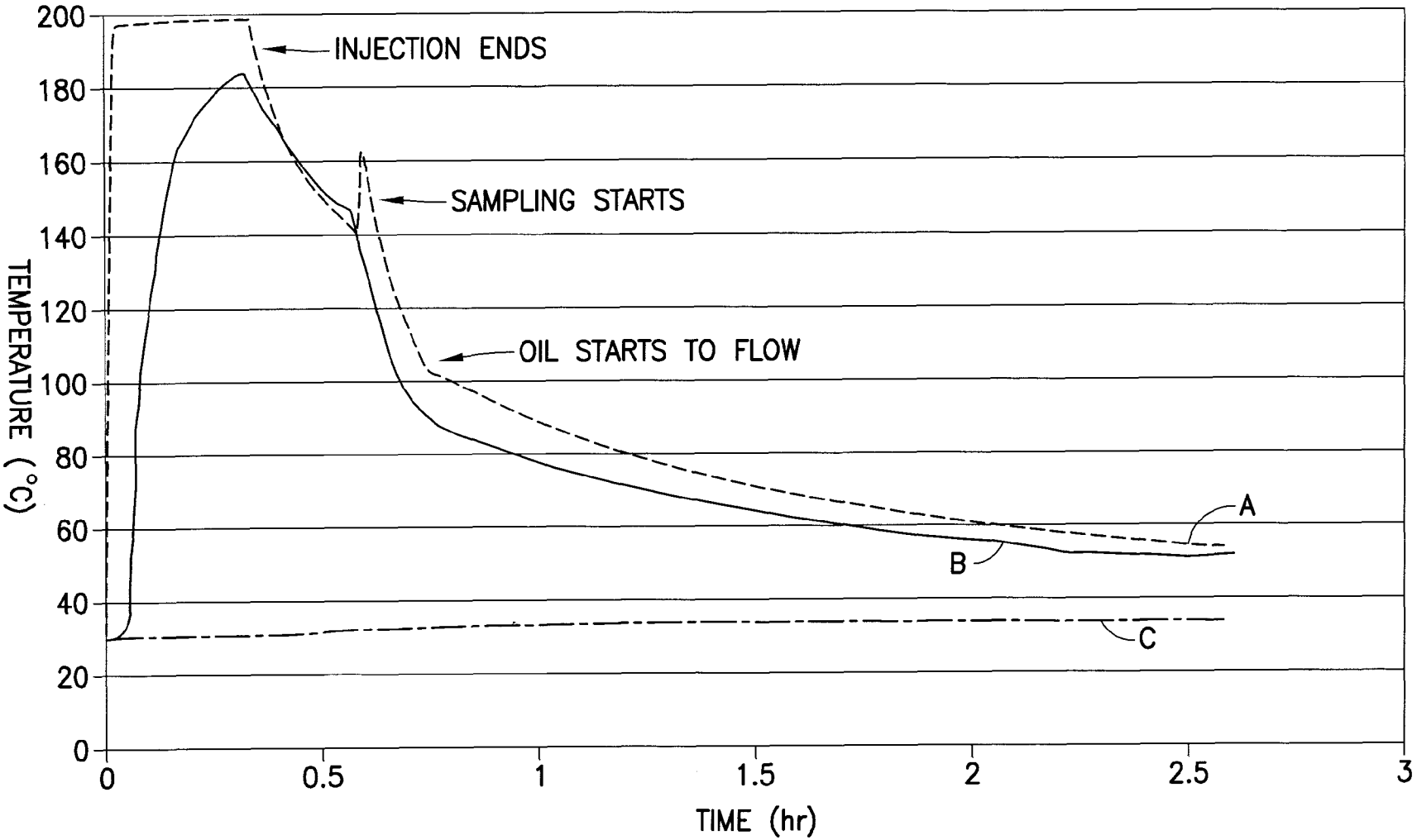
FIG. 5 is a model generated plot of temperature-time profiles at three locations in the formation after injection of hot water into the formation.

In the high-energy zone the hot fluid heats up the formation. The hot fluid is removed at the beginning of the sampling cycle and replaced by oil. The oil comes from outside the high-energy zone and is relatively cold. However, the thermal energy from the heated formation will heat the oil and the viscosity of the oil will be reduced. This will result in an intermediate period where hot fluid and oil are pumped at the same time. After a certain period all or substantially all of the injected fluid will be removed and a pure or substantially pure (e.g., 90% or more pure) oil sample will be obtained. During these processes the energy in the high-energy zone declines resulting in a lower temperature, a higher viscosity and a loss in effectiveness. This sequence is seen in FIG. 5 where the temperature profile of three locations (at the injection/sampling port—"A", 8 cm into the formation from the sampling port—"B", and 24 cm up from the second location—"C") is plotted over time utilizing the simulation discussed above with reference to FIGS. 3 and 4. Thus, at the sampling port, the temperature is seen to rise immediately to nearly 200° C. and remain there as long as the 200° C. hot water is being injected. Between the injection and the start of sampling, the temperature at the sampling port decreases to about 140° C., and at the start of sampling, a spike in temperature is seen to about 160° C. as hot fluid is drawn into the sampling port which had cooled below the sample temperature due to conduction at the borehole wall and/or by the tool. Over time, as the injected fluid and some oil is drawn out of the formation, the temperature of the mixture decreases to about 100° C., until the sample flowing is substantially oil. At that point, substantially pure oil continues to flow, and over time, as the formation loses its heat, the oil temperature reduces as seen in FIG. 5.

As seen in FIG. 5, for the monitored location 8 cm in the formation, it takes more time for the temperature to increase during injection. At some point between injection and sampling, the temperature inside the high energy zone of the formation appears to exceed the temperature at the sampling port, as there is no or limited thermal diffusion. Thus, there is no peak at the start of sampling. Otherwise, the temperature inside the formation tends to track slightly below the temperature at the sampling port.

The third monitored location which is "far" from sampling port shows a slow, very small rise in temperature over time. This suggests that the thermal energy introduced by the injected fluid stays primarily in a local zone, although some energy is conducted outside the local zone.

According to an embodiment of the invention, the hot fluid is injected into the formation at a less than a maximum rate accomplishable by the pump such that the pressure at the injection port is below a maximum. A lower pressure might be desirable for many reasons such as to prevent damaging the formation if it is unconsolidated, to prevent the formation from cracking, to prevent the hydrocarbons in the formation from reaching a bubble point, etc. Regardless, this lower injection rate allows more time for the diffusion of the thermal energy into the formation, thereby reducing the viscosity of the oil and enhancing the ability of the injected water to push the oil. As a result, a smaller volume of fluid is required to enable heating of the oil. If desired, a pressure sensor located close to or at the injector port may be provided. The pressure sensor may be used to provide feedback in order to control pump rates.

According to another embodiment of the invention, the hot fluid is injected in boluses; i.e., a certain amount of hot fluid is injected, followed by a break, followed by additional fluid injection, followed desired by another break and more injection, etc. The break(s) allow(s) for more diffusion of the energy making the oil more mobile and reducing the volume of fluid required to enable heating of the oil. If desired, variable waiting times (breaks) can be used between the injections. Also, if desired, the division of the total volume over the injection steps can be varied; i.e., two or more of the injection steps can involve different volumes.

According to another embodiment of the invention, the rate of injection may be varied during injection or, where fluid is injected in steps, from one injection step to another. For example, the injection rate can be slowly raised during an injection. The rise in injection rate can be adjusted based on the results of pressure measurements.

Depending on the characteristics of the formation, the required sample size, the maximum water content and the maximum sample time, different injection methods might be selected. As seen in FIG. 3, a 20 second waiting period between injection and sampling results in higher initial flow of oil but the flow rate drops more quickly than with a waiting period of 15 minutes. The injection with a reduced injection rate of 4500 ml/hr increases the initial flow rate and reduces the drop in flow rate over time. However, it also doubles the injection time and therefore increases the total time. The optimum injection procedure is also dependent of the reservoir permeability and the initial viscosity of the oil.

According to one embodiment of the invention, the total volume of the injected hot water/steam can be selected to minimize to the total time required to obtain a sample. A larger injection volume means a longer injection time and also a longer period that no hydrocarbons are produced. If the required sample size is relatively small and the total time available is limited, the use of smaller injection volumes can be favorable. Simulations with permeability of 1000 mD, an oil viscosity of 1000 cp, a maximum injection rate of 9000 ml/hr and 1.5 hour time limit show that the injection of two liters of hot water produces more oil in this time period than the injection of three or four liters.

One goal of the injection of hot fluid into the formation is to create a high-energy zone that enlarges the area where most of the pressure drop takes place. According to one embodiment, two or more injection ports are provided in order to enlarge the surface area of the high-energy zone without injecting more fluids. According to one embodiment, the injection ports are sufficiently close together (by way of example only, less than 15 cm apart) such that the high-energy zones in front of the injectors are connected.

According to one embodiment, the sample rate is chosen to obtain a more pure or larger sample. Results indicate that the sample rate has a minimum influence on the quality and quantity of the retrieved sample. The sample rate reduces over time and is limited mainly by the properties of the formation and the viscosity of the oil. Initial sampling at a rate higher than 9000 ml/hr will remove the hot fluid and start the flow of oil a little earlier than would otherwise be obtained with a lower sampling rate, but will not change the quality or size of the oil sample dramatically.

The start of the hydrocarbon flow can be detected with a viscosity meter or by measuring the temperature as suggested by FIG. 5, or by use of an optical flow analyzer. The first fraction sampled is generally the injected hot fluid which can be stored separately or disposed (typically by ejection into the borehole). If the liquid injected into the formation is heated to about 200° C., the temperature of this fraction will typically be above 100° C. After the hot fluid fraction there will be an intermediate (second) fraction containing the hot fluid and formation hydrocarbons. In time, the fluid concentration in this second fraction will become less and a more pure or substantially pure hydrocarbon fraction is obtained. Depending on the sample requirements, the third fraction, which contains substantially pure hydrocarbons can be collected in a sample bottle (e.g., in a chamber of the reactant holding chamber block or fluid collecting chamber block). According to one embodiment, where the temperature profile of the sampled fluid is obtained, the temperature may be used to determine when a substantially pure formation fluid sample can be collected. Thus, when the temperature of the incoming sample drops to the selected temperature, sample collection (storage) starts. Alternatively, collection can start from a certain defined time after the temperature of the sample drops to a selected temperature.

According to one embodiment of the invention, one or more of the pressure, the temperature, and the flow rate are recorded during the injection and/or sampling procedure. When all three are recorded, a complete profile will be available. According to another embodiment of the invention, during the sampling the viscosity is monitored as well to determine the change from water to hydrocarbons.

During sampling the high-energy zone loses part of its energy to the hydrocarbons that are entering from outside the high-energy zone and passing to the sampling port. This decline in energy will cause the viscosity of the hydrocarbons in the high-energy zone to increase and will thus decline the effectiveness of this zone. To maintain the effectiveness of the high-energy zone, according to one embodiment of the invention, the high-energy zone is provided with energy from other sources.

According to one embodiment of the invention, during sampling, the first fraction of hot fluid is collected (e.g., in a chamber of the reactant holding chamber block or fluid collecting chamber block). That hot fluid is then re-injected to increase (or maintain) the energy in the high-energy zone and stimulate the flow again.

According to another embodiment, one or more electrical heating elements located around the sampling probe are used to maintain the high-energy zone. The electrical heating elements may be powered by a power source in the tool or by a power source on the surface via the wireline. Energy from the heating elements may be applied during injection and/or during sampling in order to prolong the time that the high-energy zone around the sampling port is maintained.

According to a further embodiment, electromagnetic energy is used to support the high-energy zone. The electromagnetic elements may be powered by a power source in the tool or by a power source on the surface via the wireline. Energy from the electromagnetic elements, typically at a frequency on the order of between 1 GHz and 2 GHz may be applied during injection and/or during sampling in order to prolong the time that the high-energy zone around the sampling port is maintained.

According to one embodiment of the invention, the sampling tool is adapted to obtain information regarding one or more of (i) the viscosity of the sample, (ii) the temperature of the sample, (iii) the injection and sampling pressures, and (iv) the injection and sampling flow rates. Information obtained by the sampling tool may be used to further characterize the formation and the hydrocarbons. For example, it is known that the temperature and viscosity measurements give a good characterization of the temperature dependence of the oil. Extrapolation of this data to the formation temperature will give the viscosity of the oil in the formation.

According to one embodiment of the invention, the flow rate of fluid from the reservoir Q is given by $Q \propto \Delta p \cdot k/\eta$ where $\Delta p$ is the pressure difference applied during sampling or injection, $\eta$ is the fluid viscosity and k the permeability. The pressure difference, the flow rate and the viscosity are measured and thus an indication of the permeability can be calculated from these values.

According to a method of the invention, information regarding the formation and the in situ oil is gathered. The information can include one or more of the oil viscosity, the formation permeability and the temperature of the formation. This can be performed by any suitable technique such as, but not limited to NMR or acoustic monitoring. Sample requirements like the minimum sample size, the maximum sample time, and the maximum allowable water content may be determined. Based on the sample requirements and the available information of the in situ oil, and (if desired or available) previous data and the use of formation modeling tools, a sampling procedure can be established. For example, reaction requirements such as the amount of energy needed per liter of fluid to increase the temperature of the fluid to a desired temperature (e.g., 200° C.), the desired pH, and the need for reagents to improve the permeability are determined. Tool-based specifications like maximum temperature and material specifications regarding corrosion resistance are obtained.

Based on the above, a reaction to generate a neutral, alkaline or acidic pH is selected. If necessary, the chemicals to improve the permeability are chosen. Based on the temperature of the reservoir, the required amounts of the chemicals are chosen making sure that the final temperature does not exceed the maximum temperature the tool can handle.

Reactants are then placed in the tool in separate chambers. The tool is brought down the borehole and placed in position. An exothermic reaction utilizing the reactants is then generated by adding the chemicals together either in the tool, in the formation, or in the borehole adjacent the formation according to any of the techniques previously discussed. If desired, sensors can be used to monitor the injection pressure, and the injection procedure can be modified in response thereto. Also, if available and desired, supplemental heating may be provided to the formation by electric or electromagnetic means.

After the desired amount of fluid is injected into the borehole or formation, pumps are used to cause the pressure at the tool probe or port to drop below the local formation pressure, and thereby induce formation fluids which have been warmed by the formation to flow into the tool. Pumping can start directly after injection or after a waiting period. Pumping is most effective at full speed of the pump, although pumping can be controlled as desired. Temperature sensors and viscosity meters can be used to monitor the incoming fluids and retrieve information about the content of the fluid entering the tool. Alternatively, or in addition, a fluid analysis module can be used to monitor the incoming fluids and obtain information about their contents. This information can be used to determine when the hydrocarbons start to flow and the pumped fluids should be collected as opposed to being expelled from the tool.

In one embodiment of the invention, the pumps of a sampling tool which are utilized to pump fluid from the formation into the tool are used to pump the hot fluid into the formation; i.e., the pumps which are utilized to pump fluid from the formation into the tool may be used in reverse in order to pump hot fluid into the formation. In another embodiment of the invention, separate pumps are used for injecting hot fluid into the formation and withdrawing fluid from the formation into the sampling tool. In one embodiment, the hot fluid is injected through the probe port of the sampling tool through which fluid from the formation is withdrawn. In another embodiment the hot fluid is injected through a separate port. As will be appreciated by those skilled in the art, various pump, port, and storage combinations can be used. By way of example only, and not by way of limitation, some of those combinations are described hereinafter.

Figure 6:
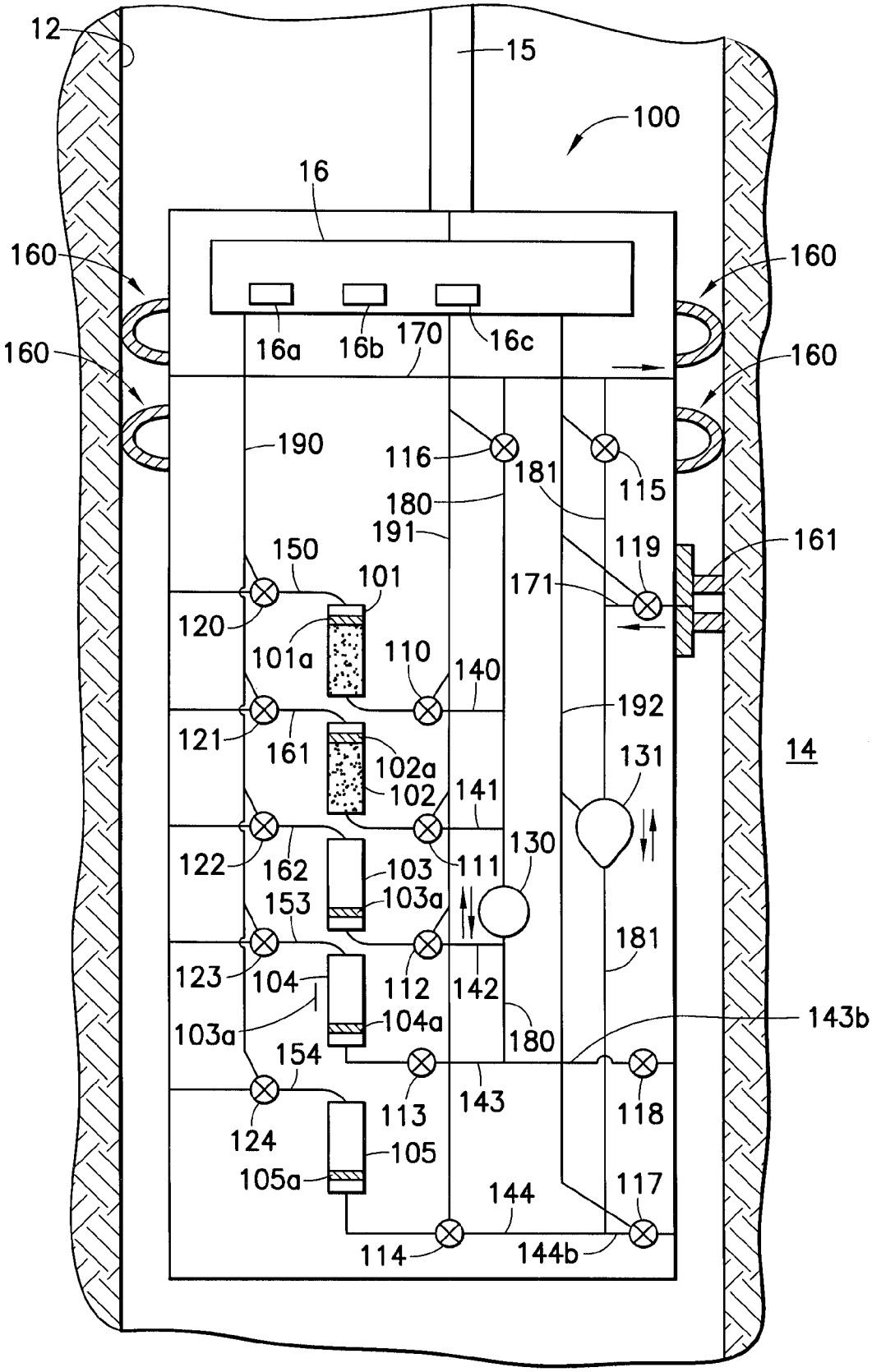
FIGS. 6-10 are diagrams of five alternate embodiments of tools of the invention which can be used to implement methods of the invention.

Turning now to FIG. 6, one example of an embodiment of the invention is illustrated in which formation testing tool 100 is shown in borehole 12 of formation 14. Those skilled in the art will appreciate that the formation testing tool 100 can be conveyed downhole after drilling using a wireline or a tractor or coiled tubing in an open or cased hole, or a logging while drilling (LWD) formation tester can be incorporated in a drill string and can be used while drilling. The tester components can also be part of a well testing tool, to be used in an open or cased hole. A schematic conveyance means 15 is shown in FIG. 2 as an electrical cable that optionally allows signal communication with the surface with a telemetry system as known in the art. In some cases, conveyance means 15 has an inner bore (not shown) that allows for mud circulation from the surface, as known in the art. In this cases, mud circulated into conveyance means 15 may also be circulated through tool 100.

Tool 100 is provided with a plurality of storage elements 101, 102, 103, 104 and 105, with storage elements 101-104 connected to main flow line 180, and storage element 105 connected to main flow line 181. The storage elements may take the form of bottles, cavities in one or more solid elements, containers, chambers, etc., and may be integral with or removable from the tool, and are hereinafter referred to as "chambers". The chambers can be any size or shape desired. While five chambers are shown, any number of chambers, having any configuration and size may be used. In addition, one or more of the chambers can be configured, if desired, to hold specific types of materials. Thus, a chamber can have a special liner (or particular mixers, spinners, etc.) adopted for a specific material. At least two (four shown) of the chambers are preferably capable of holding a reactant (fluid or solid), such that different reactants may be simultaneously lowered down within tool 100. At least one of the chambers is capable of holding a formation fluid such that a fluid sample may be brought up to the surface. The chambers may comprise, as shown, a sliding piston 101*a*, 102*a*, 103*a*, 104*a*, 105*a*, the backs of which are selectively exposable to borehole (mud) pressure by enabling valves 120, 121, 122, 123 or 124 on flow lines 150, 151, 152, 153 or 154 respectively.

Controller 16, preferably operating from instructions sent from the surface with a telemetry system, and comprising for example a signal communication line via conveyance mean 15 and a downhole telemetry module 16*c*, operates by opening or closing respective valves. In this manner it is possible to selectively release one or more materials (or to mix one or more material(s)) from one or more chambers into the formation, while maintaining other materials within their respective chambers. Controller 16 may also control pumps 130 and 131 (pump rate, pumping direction) and collect data on flow rate induced by the pumps in either of flow lines 180 and 181. The valves and pumps are controlled by signals from controller 16, for example, via control buses 190, 191, or 192. Controller 16 may alternatively operate from instructions from within (for example from processor 16*a* and/or memory 16*b*) or from a combination of instructions from within and instructions sent from the surface with a telemetry system.

As shown in FIG. 6, intake and outtake of pumps 130 or 131 are connected to flow lines 180 or 181, respectively. Flow line 180 connects one port of pump 130 to chambers 101 and 102, via flow line 140 and valve 110, or via flow line 141 and valve 111, respectively. Flow line 180 also connects the other port of pump 130 to chambers 103 and 104, via flow line 142 and valve 112 or via flow line 143*a* and valve 113, respectively. Flow line 181 connects one port of pump 131 to chamber 105 via flow line 144 and valve 114. It should be appreciated by those skilled in the art that the pumps are not required (any fluid transfer device could be used) and if pumps are used (any number desired) they could be placed in different locations depending on the user's preference and the specific application to be performed. While pumps are shown as bidirectional pumps in FIG. 6, those skilled in the art will appreciate that other flow line routing may not require bidirectional pumps.

By way of example, pump 130 could pump a reactant from chamber 102 via enabled valves 111 and flow line 141 into chamber 104 via enabled valves 113 and flow line 143. The movement of sliding pistons in chambers 102 and 104 may be assisted by borehole pressure by connecting the chambers to the well bore 12 through enabled valve 121 and flow line 151 or enabled valve 123 and flow line 153. Alternatively, if desired, and by way of example, a reactant from chamber 101 can be introduced into cavity 104 using valves 110, 120, 113 and 123. Mixing is accomplished when it is desirable to cause an exothermic chemical reaction to produce heat to introduce into the well formation as previously described in great detail. The resulting mixture may then be applied to the formation.

The tool 100 is shown with a single probe 161, and a dual or straddle packer 160 which each establish fluid communication between a flow line in the tool and the formation. Both the probe 161 and packer 160 are capable of permitting fluid to be injected into the formation, or of receiving fluids produced from the formation, although as shown, fluid is injected into the borehole and then into the formation through the packer 160, and formation fluid is produced through the probe 161 and into the tool 100. While not shown, the tool could also include the drilling feature as present in the Schlumberger Cased Hole Dynamics Tester (CHDT) or perforating guns to perforate the formation or the well casing, for example located within dual packer 160 interval and/or within probe 161 inlet. The tool can have other sealing devices, such as the packer system described in provisional application, U.S. Patent Application No. 60/845,332, entitled "ADJUSTABLE TESTING TOOL AND METHOD OF USE", priority from which is claimed herein, and the disclosure of which is incorporated herein.

Thus, a mixture of reactants (e.g., in chamber 104) may be introduced into the formation in conjunction with dual packer 160 by reversing pump 130, and enabling valves 113 and 116. Note that the use of testing tool 100 is not restricted to mixing of reactants within the tool, and that the selected reactants may be individually introduced directly into the borehole adjacent the formation or into the formation directly, and the mixing to cause an exothermic reaction may occur in the borehole adjacent the formation or within the formation itself.

As shown in FIG. 6, a mixture can be injected into the borehole 12 and then into the formation 14 at the dual packer 160, while formation fluids are extracted at probe 161. Extraction of fluids can be achieved with pump 131, through line 171 by opening valve 119. Since initially the fluid being extracted from the formation will consist substantially of the injected mixture, by opening valve 117, the fluid can be dumped into the borehole 12 via flow line 144*b*. When formation oils are being produced, and it is desired to store a sample in chamber 105, valves 114 and 124 may be opened and valve 117 may be closed.

Extraction of fluids from the formation may also be accomplished through the dual packer 160. Initially, when the fluid being extracted consists substantially of the injected mixture, pump 131 is utilized with valves 115 and 117 opened. When storage of a sample in chamber 105 is desired, valves 114 and 124 may be opened and valve 117 may be closed. Dual packer 160 can also extract formation materials with pump 130, opening valves 116 and 118, and dumping fluid into the borehole via flow line 143*b*. When a sample is desired, for example in cavity 103, valves 112 and 122 may be opened and valve 118 may be closed.

Sensors (not shown) may be located within one or more chambers or along one or more flow lines. The sensors, such as pressure sensors, temperature sensors, viscosity sensors or resistivity sensors, measure characteristics of the formation fluid that is drawn into the tool or characteristics of materials injected into the formation, and may be used to interpret the testing of formation 14. For example, after injecting different acids, the produced fluids can further be analyzed using downhole fluid analysis techniques, (such as pH, color, ionic content, chemical sensors for presence detection of carbon dioxide, hydrogen sulfide, tracing elements, or heavy metal presence, and the like) to understand the mineralogy of the formation.

Other sensors (not shown) may also be located on the body of tool 100, on probe 161 or on dual packers 160. These sensors measure characteristics of the formation fluid or injected fluid that are still in the formation and/or characteristics of the formation rock, and may be also used to interpret the testing of formation 14.

Some examples of sensors that could be used are sensors that measure resistivity data, dielectric data, Nuclear Magnetic Resonance (NMR) data, neutron formation and fluid spectroscopic data including thermal decay and Carbon/Oxygen ratio, acoustic data, streaming potential data, and data from tracked marker fluids (radioactive or non-radioactive markers) and bacterial activity.

The sensors can be used to monitor injection, soaking and back production periods. Transient pressure and flow rate data, measured for example in flow lines into the tool can also be used to assess the effectiveness of the injection. They can also be used to assess any damage due to asphaltene precipitation in the formation.

Note that any number of different materials and reactants can be contained in the various cavities. For example, acids (various stems in different chambers if desired), solvents, nitrogen, carbon dioxide, polymers, surfactants, caustic solutions, micelle solutions, flue gases, steam, pure hydrocarbon gases or their mixtures, or natural gas may all be carried downhole. As will be discussed herein, selected materials can be injected into the formation to achieve proper testing of the formation material. Also note that injection of certain solvents, such as heptane and methane, may stabilize asphaltenes and cause them to drop out of solution. The back produced fluid can be analysed using downhole fluid analysis techniques to detect in-situ asphaltene formation and determination as discussed above.

Figure 7:
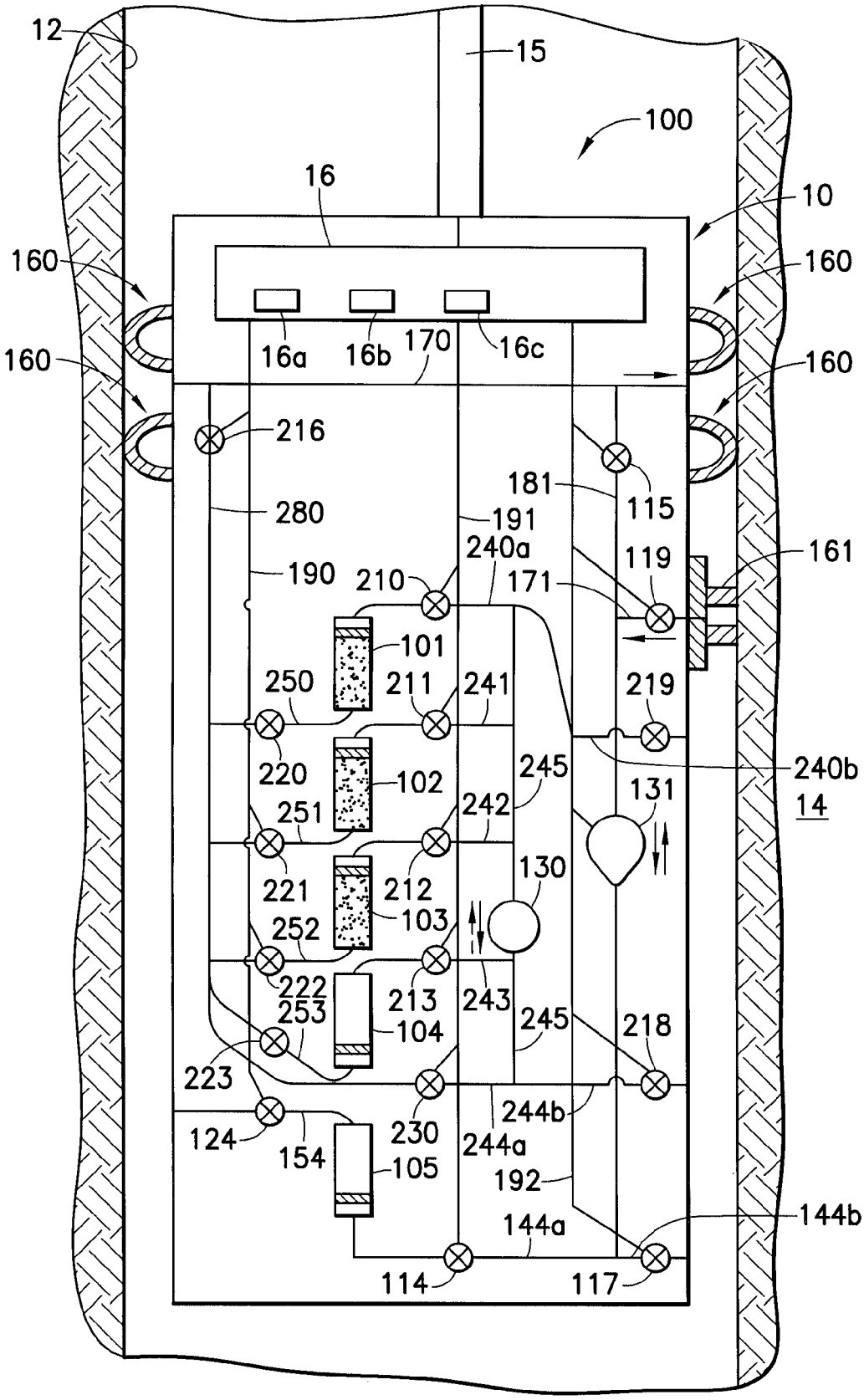

FIG. 7 shows another embodiment of downhole testing tool 100*a* which is similar to the tool illustrated in FIG. 6, except that an alternate hydraulic circuit (flow line 280 with valves 220, 221, 222, 223) connecting chambers 101, 102, 103, 104 and 105, packer 160, and pump 130 is provided. The alternate circuit is beneficial when corrosive materials needs to be manipulated, especially if this material may corrode elements of a fluid transfer device.

More particularly chambers 101, 102, 103 and 104 are selectively connected to main flow line 280 by flow lines 250, 251, 252 or 253 and valves 220, 221, 222 or 223 respectively. Chambers 101, 102, 103 and 104 may include sliding pistons, the backs of which are selectively exposable to a working fluid in flow line 245 (here mud from borehole 12) by enabling valves 210, 211, 212 or 213 on flow lines 240*a*, 241, 242 or 243 respectively.

By way of example, the intake and outtake of pump 130 are connected to flow line 245. Flow line 245 connects one port of pump 130 to chambers 101, 102 and 103, via flow line 240*a* and valve 210, or via flow line 241 and valve 211, or via flow line 242 and valve 212, respectively. Flow line 245 also connects the other port of pump 130 to chamber 104, via flow line 243 and valve 213. In the arrangement of FIG. 7, pump 130 is used to circulate mud (from the borehole). With other arrangements, it may alternatively circulate a hydraulic fluid from a reservoir (not shown).

Continuing with the example, pump 130 could pump material from chamber 101 via enabled valves 220 and flow line 250, into chamber 104 via enabled valves 223 and flow line 253, by displacing sliding pistons in cavities 101 and 104. Sliding pistons are displaced by mud circulation in flow lines 245, 240 (by enabling valve 210) and 243 (by enabling valve 213). As another example, a material from chamber 103 can be introduced into chamber 104 using valves 222, 212, 223 and 213. If desired, a material from chamber 102 can be further introduced into chamber 104 using valves 221, 211, 223 and 213.

The resulting mixture achieved in chamber 104 may then be used for testing formation 14. For example, fluid in chamber 104 may be introduced into the formation (via the borehole) in conjunction with dual packer 160 by reversing pump 130 and enabling valves 219, 213, 223 and 216. With valve 219 open, borehole fluid enters the tool through flow line 240*b* and is used to displace sliding piston in chamber 104. In some cases, injection of the mixture and/or soaking of the mixture in the formation may be monitored by sensors (not shown) in the testing tool or around the testing tool as described above.

Probe 161 may then extract formation fluids into the tool for testing. If desired, sensors (not shown) may monitor properties of the extracted fluid. This can be achieved with pump 131 in a similar way as shown in FIG. 6. Additionally, a fluid sample may also be captured in chamber 105, for example for bringing a sample to the surface.

If desired, formation fluid may be extracted at dual packer 160. This can be achieved for example with pump 131 and with valves 115 and 117 opened. When it is desired to capture a sample in chamber 105, valves 114 and 124 may be opened and valve 117 may be closed. Dual packer 160 can also extract formation materials with pump 130, opening valves 216 and 238, and dumping fluid into the borehole via flow line 244*b*. Formation fluid also may be captured in any chamber by opening and closing appropriate valves. The captured fluid (e.g., when the fluid is hot and can be used to recharge the formation energy) may then be reinjected into the formation if desired.

The configuration of chambers and valves in FIG. 6 and FIG. 7 are illustrated for example only. More or fewer than the five chambers shown may be used within the downhole testing tool. In addition, interconnection of chambers, and connection of the chambers to the main lines is not limited to the shown configurations. Chamber connections depend on the preference of the user as well as on the desired application. In addition, instead of a single probe 161 and a single packer 160, just two (or more) probes or just two or more packers can be utilized, or different numbers of each can be utilized.

Figure 8:
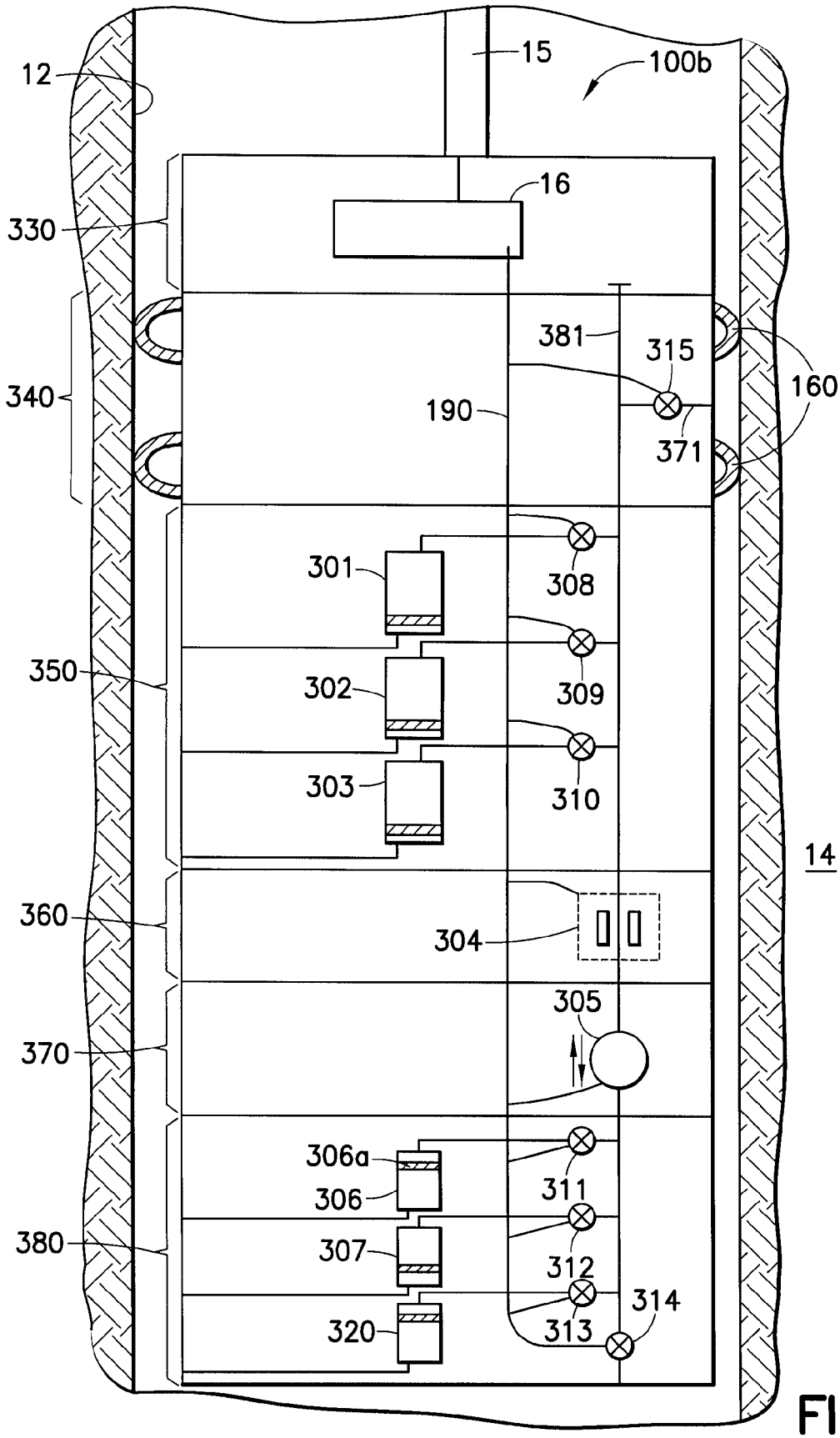

FIG. 8 shows an embodiment which illustrates another downhole testing tool 100*b* in accordance with one aspect of the invention. The construction of testing tool in FIG. 8 is modular, and preferably comprises an electronics/telemetry module 330, a dual packer module 340 comprising a dual packer 160, a material (reactants) carrier module 350, a downhole fluid analysis module 360 (including an optical fluid analyzer and/or a temperature sensor, and/or a pressure sensor, and/or a viscosity sensor, all shown as element 304), a pump module 370, and a sample carrier module 380. Note that testing tools of modular construction are known to those skilled in the art. One example of such tool is the MDT (Modular Dynamics Tester) tool of Schlumberger. The arrangement of modules depicted in FIG. 8 (and the other figures) is by way of example, and other arrangements are possible, based on the need for a particular application. For example downhole fluid analysis module 360 may be located after the pump. Also, other modules (not shown) can be added to tool 100*b* such as a probe module, a drilling module such as CHDT, or a perforating module. It should be appreciated that the tools 10, 100 and 100*a* of FIG. 1, FIG. 6 and FIG. 7 could also be constructed in a similar modular fashion.

In the example of FIG. 8, at least one main flow line 381 and at least one main bus 190 insure fluid and data communication between the modules of testing tool 100*b*. Three chambers 301, 302 and 303 as well as mixing chamber 306, flushing chamber 307, sample chamber 320, fluid analyzer 304 and pump 305 are shown connected to main flow line 381. The materials (reactants) conveyed for example in chambers 301, 302, or 303 may be selectively introduced into mixing chamber 306. If desired, mixing chamber 306 may already include a solid or liquid reactant, so that additional material from only one of the chambers 301, 302, or 303 is required to generate an exothermic reaction. Valves 308, 309, 310, and 311 control the selective mixing of materials under control of a controller 14, or directly from the surface, via bus 190.

Pump 305 may be used to move the materials along to the mixing or flushing chambers. The pump may also be used to drive the fluid to the injection point and fluid analyzer 304 may be used, if desired, to monitor the injection fluid and its properties. The various chambers are shown with back of respective pistons open to hydrostatic pressure that provides the energy to push the fluids out without excessive drawdown in the pump. Mixing chamber 306 may include a device 306*a*, such as, for example, a spinner, to ensure that the resulting mixture is homogenous. In the embodiment of FIG. 8, pump 305 is preferably bidirectional such that once the materials are mixed in the mixing chamber, the pump may be reversed to inject the mixture into the formation.

Flushing chamber 307 may include a non-reactive fluid if desired. After the materials to be combined from two or all three of chambers 301, 302 and 303 are selectively introduced into the mixing chamber, valve 312 may be opened to allow the flushing chamber fluid to flush out the flow lines connecting all of the chambers to the well formation if desired. After the flow lines are properly flushed, the mixture in the mixing chamber can be introduced into the well formation via valves 311 and 315.

Figure 9:
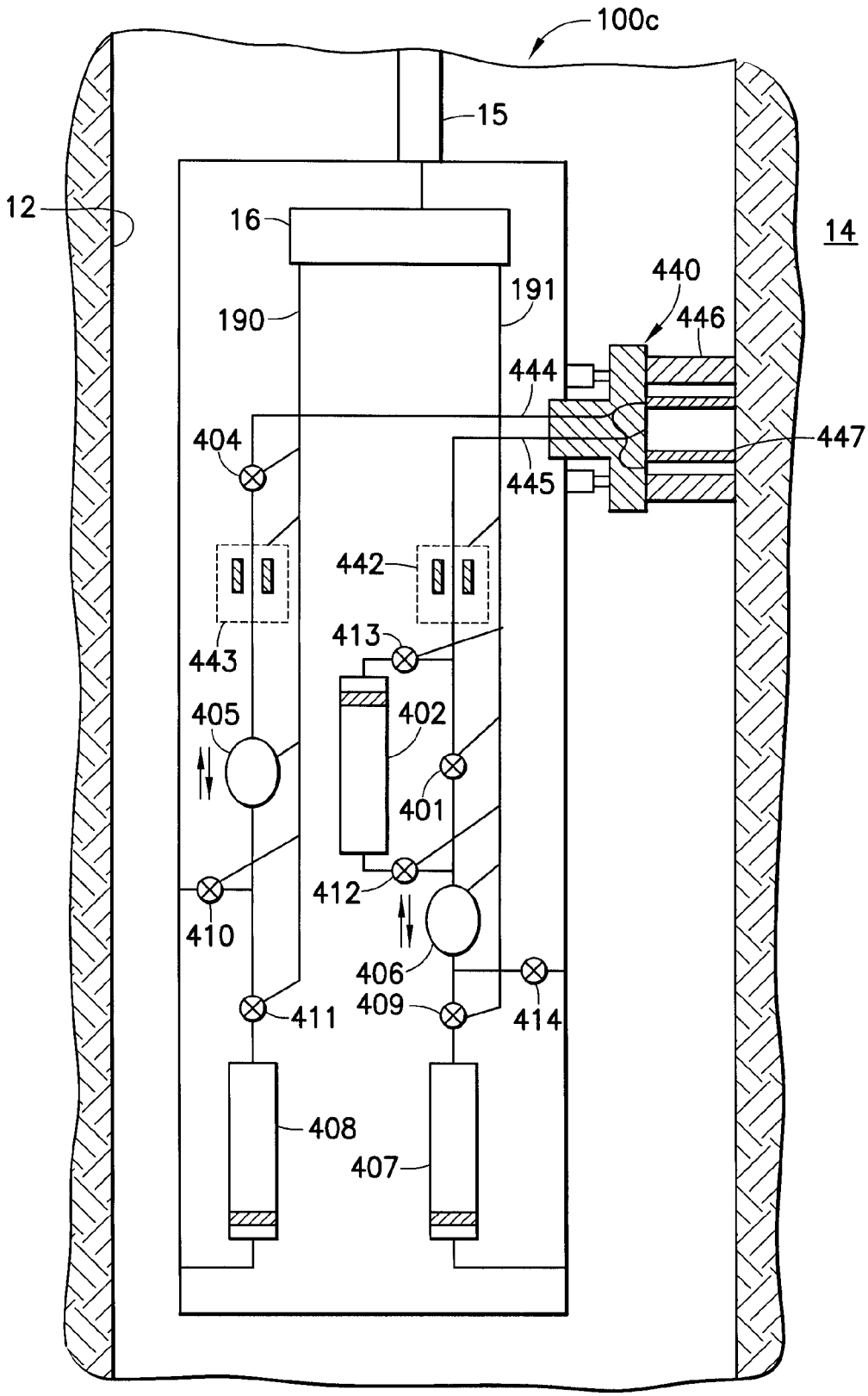

FIG. 9 shows yet another embodiment of the current invention in which chemicals are injected separately into the well formation and the mixture is allowed to occur within the formation itself. For example, mixing the chemical from chamber 407 with the chemical from chamber 408 may result in a corrosive mixture that could damage the testing tool if the mixing were to be done within a chamber of the tool. In another example, mixing the chemical from chamber 407 with the chemical from chamber 408 may result in an exothermic chemical reaction that is most efficient if the mixing is done within the formation. In such a situations, the chemicals are each introduced separately into the formation and the mixing occurs within the well formation.

In the embodiment of FIG. 9, testing tool 100*c* has an alternate probe assembly 440 comprising an inner packer 447, which probe or port is connected to flow line 545, and an outer packer 446. The space between the outer surface of the inner packer 445 and the inner surface of outer packer 446 is connected to flow line 444. Note that separate introduction of chemical in the formation does not require a probe as depicted in FIG. 9 and such introduction may also be achieved via two separate probes such as probes 161 of FIG. 6, connected to flow lines 444 and 445 respectively.

A mixing operation may be conducted with testing tool 100*c*. Thus, under control of controller 16, and acting upon a telemetry signal sent by a surface operator for example to the downhole tool 100*c*, valves 401, 409 may be opened, and pump 406 may be activated for injecting material conveyed from the surface in chamber 407 into formation 14. Simultaneously (or sequentially in any order), valves 411 and 404 may be opened, and, for example, another pump such as pump 405, may be used for injecting material conveyed from the surface in chamber 408 into formation 12. When the inner packer 447 contacts the borehole wall (as shown), the mixing of the fluids injected from cavities 407 and 408 happens in the formation. When the inner packer 447 is recessed with respect to the borehole wall (as shown in U.S. Pat. No. 6,964,301 assigned to Schlumberger, incorporated by reference herein in its entirety), the mixing may occur at the probe. Mixing of materials at the probe or directly in the formation may be desirable, for example, when an exothermic reaction is wanted from the mixing of chemicals in chambers 407 and 408, and when the mixing in a tool chamber may lead to excessive heat loss due to heat transfer through the chamber walls and the flow lines.

Tool 100*c* may also be used to test fluids extracted from the formation after the injection procedure. Thus, valves 404 and 410 may be opened and pump 405 may be used to extract fluids from the formation at the cleanup area between packer 446 and 447. Extracted fluids from this area may be returned to the borehole. Simultaneously, valves 401 and 414 may be opened and pump 406 may be used to dump into the borehole 12 fluid extracted from the formation at the inner area of packer 47. During pumping, fluid properties (such as temperature, viscosity, pressure, optical densities or resistivities) may be monitored via flow line sensors 442 or 443 or both. If desirable, testing operation may further comprise capturing a sample of extracted fluids, for example in chamber 402. For example, when sensors 442 and, or 443 sense properties indicating that a sample capture is desired, a sample may be captured in chamber 402 by opening valves 413 and 412 and by closing valve 401. If desired, extracted fluid may also be captured in chambers 407 and 408 by opening appropriate valves and working the appropriate pumps.

Those skilled in the art will appreciate that the arrangement of chambers depicted in FIG. 9 is shown as example only, and the probe assembly 440 may be used, for example, with other chamber arrangements similar to arrangements shown in FIGS. 6-8.

Figure 10:
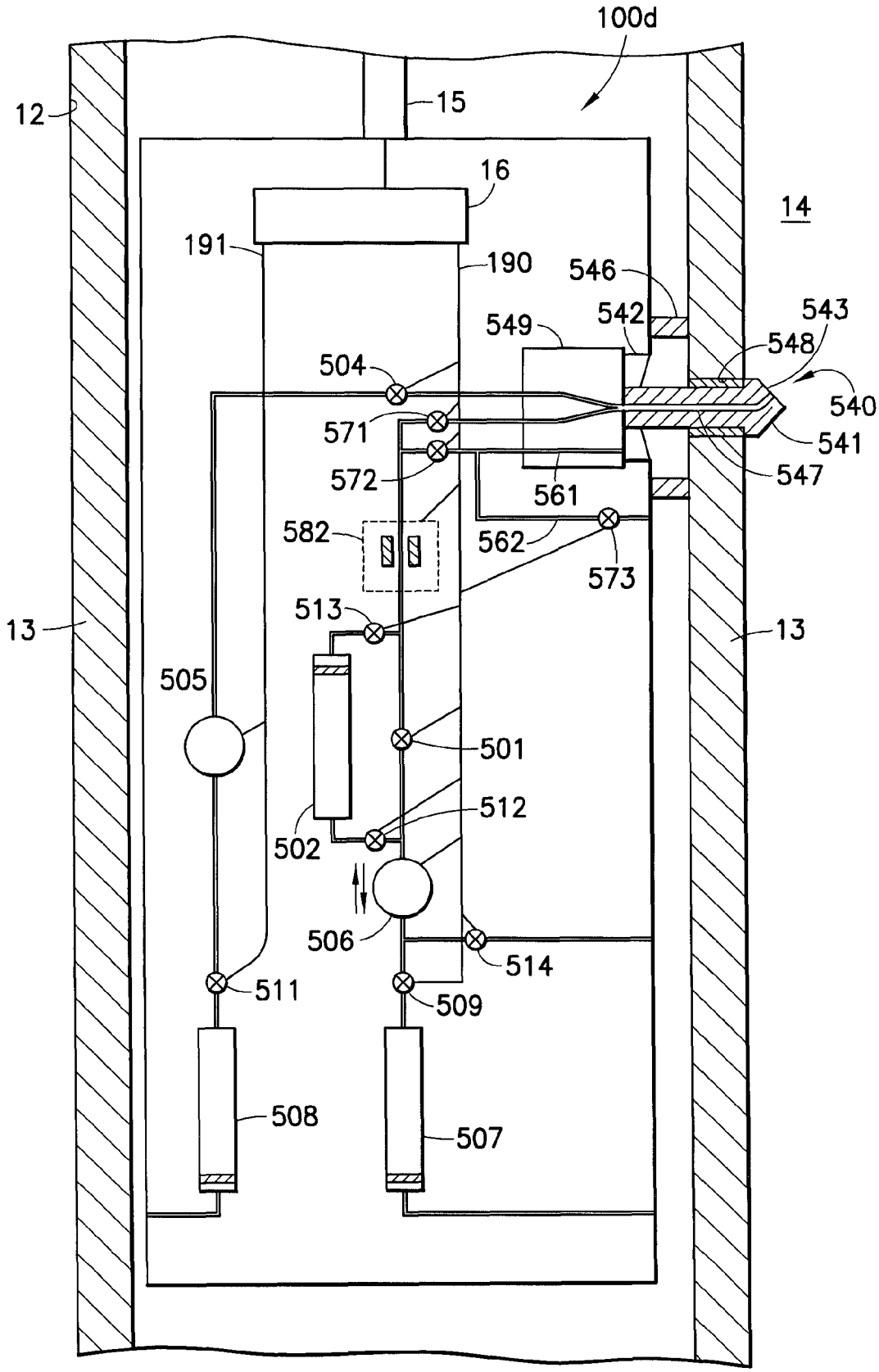

FIG. 10 shows a sectional view of another embodiment of a testing tool 100*d* in which mixing of materials occurs in a probe 540 that is equipped with a drilling feature. For example, it may be advantageous in some cases to deliver the mixture of materials conveyed downhole in chambers 508 and 507 through a casing and into the formation 12. For this purpose, a probe assembly such as probe assembly 540 may be used.

In the example of FIG. 10, a probe assembly 540 comprises a drilling device 549 capable of extending drilling shaft 542 and drilling bit 541 outside tool 100*d* and through a casing 13, and optionally into the formation 14. Drilling bit 541 is rotated by drilling device 549 to drill a hole 548 into the casing 13. Probe assembly 540 preferably also comprises a sealing device such as a cylindrical elastomeric seal 546 to establish a fluid communication between formation 14 and, for example, flow line 561 in tool 100*d*.

In the embodiment of FIG. 10, the testing tool 100*d* preferably receives a command by telemetry from a surface operator. This command may be decoded by controller 16, and controller 16 may initiate mixing of materials contained in chambers 507 and 508, for example to generate heat from an exothermic chemical reaction, by controlling valves and pumps in testing tool 10. For example, valves 509, 501 and 571 may be open and pump 506 may be used to inject material from chamber 507 into hole 548. Simultaneously, or sequentially, valves 511 and 504 may be opened and pump 505 may be used to inject material from chamber 508 into hole 548. In the example of FIG. 10, materials from chambers 507 and 508 may be mixed together at inline mixer 543 located in flow line 547. Optionally, the injected mixture (or any other fluid) may be allowed to flow back from hole 548 into well bore 12 via flow line 561, and 562 by opening valve 573. This may be advantageous when the mixture should not be injected into formation 14, for example to limit contamination of formation fluid with the generated mixture.

After injection, formation testing may be monitored by monitoring various properties of the formation 14 and/or of the fluid in formation 14, with various sensors (not shown). Preferably, testing of the formation 14 comprises extracting fluids from the portion isolated by seal 546 into flow line 561, and analysis of the properties of the extracted fluid by sensor 582 (for example a viscosity sensor, of an optical fluid analyzer). This may be accomplished after injection of the mixture, by opening valves 572, 501 and 514 and activating pump 506 to draw fluid and dump it into borehole 12. Testing may further include capturing a sample of extracted fluid into chamber 502, by opening valves 513 and 512 and closing valve 501 while still running pump 506.

There have been described and illustrated herein many embodiments of a formation oil sampling or testing apparatus and a method of sampling (testing) the oil. While particular embodiments of the invention have been described, it is not intended that the invention be limited thereto, as it is intended that the invention be as broad in scope as the art will allow and that the specification be read likewise. Thus, while the invention has been disclosed with reference to particular tools, other sampling tools can be utilized. In addition, while particular chemicals and chemical reactions have been disclosed in order to heat a fluid downhole, it will be understood that other chemicals or chemical reactions can be used. Furthermore, while particular fluids such as water, steam, hydrochloric acid solutions, etc., have been described for use, it will be understood that other fluids can be similarly used. It will therefore be appreciated by those skilled in the art that yet other modifications could be made to the provided invention without deviating from its spirit and scope as claimed.

What is claimed is:

1. A tool for expediting the downhole sampling of hydrocarbons of a formation traversed by a borehole, the tool comprising:

a first chamber carrying a first reactant;

a second chamber separate from said first chamber and carrying a second reactant, said first reactant and second reactant chosen to generate an exothermic chemical reaction when in contact with each other;

a first port coupled to said first chamber and said second chamber; and an injector coupled to said first port, said injector injecting heated injection fluid generated by causing said first reactant and said second reactant to react in an exothermic chemical reaction while in said tool through said first port and into one of the borehole or the formation.

2. The tool according to claim 1, further comprising a mixer coupled to said first chamber and said second chamber which mixes said first reactant and said second reactant.

3. The tool according to claim 2, wherein said mixer is located in one of said first chamber and said second chamber.

4. The tool according to claim 2, further comprising a third chamber coupled to said first chamber and said second chamber and said mixer is located in said third chamber.

5. The tool according to claim 2, wherein said mixer is located at said first port.

6. The tool according to claim 1, wherein said first reactant comprises water and said second reactant comprises a chemical which reacts with water in an exothermic dissolving reaction.

7. The tool according to claim 6, wherein said chemical is a salt.

8. The tool according to claim 7, wherein said salt is chosen from a group consisting of a magnesium salt, a potassium salt, an aluminum salt, and a sodium salt.

9. The tool according to claim 7, wherein said salt is at least one magnesium chloride, magnesium sulfate, aluminum bromide, aluminum chloride, potassium hydroxide and sodium hydroxide.

10. The tool according to claim 6, wherein said chemical is a chemical which when reacted with said water will generate an acid solution.

11. The tool according to claim 10, wherein said chemical which when reacted with water will generate at least one acid is chosen from phosphorous trichloride, phosphorous pentoxide, phosphorous pentachloride, and sulfur trioxide.

12. The tool according to claim 1, wherein said first reactant comprises an acid and said second reactant comprises a base.

13. The tool according to claim 12, wherein said acid is chosen from HCl and $HNO_3$, and said base is NAOH.

14. The tool according to claim 1, wherein said first reactants comprises water, and said second reactant comprises an acid.

15. The tool according to claim 14, wherein said acid is chosen from hydrochloric acid, sulfuric acid and pyro-phosphorous acid.

16. The tool according to claim 1, further comprising a third chamber coupled to said first chamber and said second chamber and containing a third reactant, wherein said first reactants comprises water, said second reactant comprises a chemical which when reacted with water will generate an acid solution, and said third reactant comprises a base.

17. The tool according to claim 1, wherein said first reactant and said second reactant are chemicals which will undergo an exothermic reduction-oxidation reaction when brought into contact with each other.

18. The tool according to claim 1, further comprising means for withdrawing into the tool at least some of the injection fluid and some formation hydrocarbon fluid from the formation.

19. The tool according to claim 18, wherein said means for withdrawing comprises a pump.

20. The tool according to claim 19, further comprising a third chamber for storing substantially pure formation hydrocarbon fluid.

21. The tool according to claim 20, further comprising a first flow line coupled to said first chamber, said second chamber and said first port; and a second flow line coupled to said third chamber.

22. The tool according to claim 21, further comprising a plurality of valves coupling said first flow line to said first chamber, said second chamber, and said first port, and coupling said second line to said third chamber.

23. The tool according to claim 21, further comprising a second port coupled to said means for withdrawing and to said third chamber.

24. The tool according to claim 23, wherein said first port is one of a packer assembly and a probe assembly, and said second port is one of a packer assembly and a probe assembly.

25. The tool according to claim 21, further comprising monitoring means for monitoring fluid flowing through said second flow line.

26. The tool according to claim 25, wherein said monitoring means comprises at least one of an optical fluid analyzer, a pressure sensor, a temperature sensor, and a viscosity sensor.

27. The tool according to claim 1, wherein said first port is a packer assembly.

28. The tool according to claim 1, wherein said first port is a probe assembly.

29. The tool according to claim 1, further comprising a drilling assembly, wherein said first port is incorporated in said drilling assembly.

30. The tool according to claim 1, further comprising means for withdrawing into the tool at least some heated fluid generated by an exothermic chemical reaction of said first fluid reactant and said second fluid reactant and some formation hydrocarbon fluid from the formation.

31. The tool according to claim 1, further comprising a fluid analysis device that analyzes at least some heated fluid generated by an exothermic chemical reaction of said first fluid reactant and said second fluid reactant and some formation hydrocarbon fluid from the formation.

32. A tool for expediting the downhole sampling of hydrocarbons of a formation traversed by a borehole, the tool comprising:

a first chamber carrying a first fluid reactant;

a second chamber separate from said first chamber and carrying a second fluid reactant, said first fluid reactant and second fluid reactant chosen to generate an exothermic chemical reaction when in contact with each other;

a mixer coupled to said first chamber and said second chamber which mixes said first reactant and said second reactant, wherein said mixer is located in one of said first chamber or said second chamber; and a first port coupled to said first chamber and said second chamber; and an injector coupled to said first chamber, said second chamber and said first port, said injector injecting said first fluid reactant and said second fluid reactant into one of the borehole or the formation.

33. The tool according to claim 32, further comprising means for withdrawing into the tool at least some heated fluid generated by an exothermic chemical reaction of said first fluid reactant and said second fluid reactant and some formation hydrocarbon fluid from the formation.

34. A downhole device for expediting the downhole sampling of hydrocarbons of a formation traversed by a borehole, the downhole device comprising:

a first chamber carrying a first fluid reactant;

a second chamber separate from said first chamber and carrying a second fluid reactant, said first fluid reactant and second fluid reactant chosen to generate an exothermic chemical reaction when in contact with each other;

a third chamber coupled to said first chamber and said second chamber and containing a third reactant, wherein said first reactants comprises water, said second reactant comprises a chemical which when reacted with water will generate an acid solution, and said third reactant comprises a base; and a first port coupled to said first chamber and said second chamber; and an injector coupled to said first chamber, said second chamber and said first port, said injector injecting said first fluid reactant and said second fluid reactant into one of the borehole or the formation.

* * * * *